US009333519B2

(12) United States Patent
Brose et al.

(10) Patent No.: US 9,333,519 B2
(45) Date of Patent: May 10, 2016

(54) SPRAY GUN AND ACCESSORIES

(75) Inventors: Jens Brose, Ottmarsheim (DE); Alexander Tschan, Kornwestheim (DE); Peter Dettlaff, Remseck (DE)

(73) Assignee: SATA GmbH & Co. KG, Kornwestheim (DE)

( * ) Notice: Subject to any disclaimer, the term of this patent is extended or adjusted under 35 U.S.C. 154(b) by 246 days.

(21) Appl. No.: 13/991,285

(22) PCT Filed: Nov. 19, 2011

(86) PCT No.: PCT/EP2011/005842

§ 371 (c)(1), (2), (4) Date: Aug. 13, 2013

(87) PCT Pub. No.: WO2012/072205

PCT Pub. Date: Jun. 7, 2012

(65) Prior Publication Data

US 2013/0320110 A1 Dec. 5, 2013

(30) Foreign Application Priority Data

Dec. 2, 2010 (DE) ..... 10 2010 053 026

(51) Int. Cl.
*B05B 7/00* (2006.01)
*B05B 7/24* (2006.01)

(52) U.S. Cl.
CPC ..... *B05B 7/2489* (2013.01); *B05B 7/2408* (2013.01); *B05B 7/2478* (2013.01)

(58) Field of Classification Search
CPC .... B05B 7/2489; B05B 7/2408; B05B 7/2478
USPC ..... 239/345, 525, 526, 290, 291, 292, 302, 239/310, 311, 327, 375, 376, 377, 379
See application file for complete search history.

(56) References Cited

U.S. PATENT DOCUMENTS 40,433 A 10/1863 Sees
459,432 A 9/1891 Anderson
(Continued)

FOREIGN PATENT DOCUMENTS

AT 153883 6/1997
AT 163577 3/1998
(Continued)

OTHER PUBLICATIONS

English translation of International Preliminary Report published Jun. 4, 2013 for PCT/EP2011/005842.
(Continued)

*Primary Examiner* — Justin Jonaitis
(74) *Attorney, Agent, or Firm* — Paul D. Bianco; Fleit Gibbons Gutman Bongini & Bianco PL

(57) ABSTRACT

A spray gun with a gun body having a handle region and having a head which is equipped with a cartridge which has an angled, tubular region as an inlet for a material-conducting channel which runs through the cartridge and ends in an outlet region which is arranged at the front end of the head of the spray gun, wherein the inlet region of the cartridge is connected or is connectable to a storage container for the material to be sprayed, and wherein the cartridge preferably guides at least one material-conducting component of the spray gun. The cartridge is held fixedly, but releasably, on the head of the spray gun by means of a screw collar ring, wherein the screw collar ring is preferably supported on the cartridge and/or on or in the head of the spray gun by at least one mechanism.

16 Claims, 21 Drawing Sheets

(56) References Cited

U.S. PATENT DOCUMENTS

| | | | |
|---|---|---|---|
| 459,433 | A | 9/1891 | Avery |
| 548,816 | A | 10/1895 | Paul |
| 552,213 | A | 12/1895 | Troy |
| 552,715 | A | 1/1896 | Lugrin |
| 563,505 | A | 7/1896 | McCornack |
| 581,107 | A | 4/1897 | Emery |
| 644,803 | A | 3/1900 | Justi |
| 672,012 | A | 4/1901 | Ruper |
| 574,880 | A | 5/1901 | Schmidt et al. |
| 1,889,201 | A | 11/1932 | Holveck |
| 2,125,445 | A | 8/1938 | Holveck |
| 2,646,314 | A | 7/1953 | Peeps |
| 3,417,650 | A | 12/1968 | Varrin |
| 3,583,632 | A | 6/1971 | Shaffer |
| 3,746,253 | A | 7/1973 | Walberg |
| 3,747,850 | A | 7/1973 | Hastings et al. |
| 3,857,511 | A | 12/1974 | Govindan |
| 3,873,023 | A | 3/1975 | Moss et al. |
| 4,562,965 | A | 1/1986 | Ihmels et al. |
| 5,064,119 | A | 11/1991 | Mellette |
| 5,078,323 | A | 1/1992 | Frank |
| 5,080,285 | A | 1/1992 | Toth |
| 5,088,648 | A | 2/1992 | Schmon |
| 5,090,623 | A | 2/1992 | Burns et al. |
| 5,190,219 | A | 3/1993 | Copp, Jr. |
| 5,249,746 | A | 10/1993 | Kaneko et al. |
| 5,456,414 | A | 10/1995 | Burns et al. |
| 5,533,674 | A | 7/1996 | Feyrer et al. |
| 5,540,385 | A | 7/1996 | Garlick |
| 5,540,386 | A | 7/1996 | Roman |
| 5,613,637 | A | 3/1997 | Schmon |
| 5,941,461 | A | 8/1999 | Akin et al. |
| 5,992,763 | A | 11/1999 | Smith et al. |
| 6,056,213 | A | 5/2000 | Ruta et al. |
| 6,091,053 | A | 7/2000 | Aonuma |
| 6,276,616 | B1 | 8/2001 | Jenkins |
| 6,402,062 | B1 | 6/2002 | Bending et al. |
| 6,435,426 | B1 | 8/2002 | Copp, Jr. |
| D474,528 | S | 5/2003 | Huang |
| 6,585,173 | B2 | 7/2003 | Schmon et al. |
| 6,845,924 | B2 | 1/2005 | Schmon |
| 6,855,173 | B2 | 2/2005 | Ehrnsperger et al. |
| 6,874,708 | B2 | 4/2005 | Reetz, III |
| 6,877,677 | B2 | 4/2005 | Schmon et al. |
| 7,017,838 | B2 | 3/2006 | Schmon |
| 7,018,154 | B2 | 3/2006 | Schmon |
| 7,083,119 | B2 | 8/2006 | Bouic et al. |
| 7,175,110 | B2 | 2/2007 | Vicentini |
| RE40,433 | E | 7/2008 | Schmon |
| D574,926 | S | 8/2008 | Huang |
| 7,416,140 | B2 | 8/2008 | Camilleri et al. |
| 7,540,434 | B2 | 6/2009 | Gohring |
| 7,542,032 | B2 | 6/2009 | Kruse |
| 7,568,638 | B2 | 8/2009 | Gehrung |
| 7,614,571 | B2 | 11/2009 | Camilleri et al. |
| 7,694,893 | B2 | 4/2010 | Zittel et al. |
| 7,694,896 | B2 | 4/2010 | Turnbull et al. |
| 7,810,744 | B2 | 10/2010 | Schmon et al. |
| 7,819,341 | B2 | 10/2010 | Schmon et al. |
| 7,823,806 | B2 | 11/2010 | Schmon |
| 8,052,071 | B2 | 11/2011 | Kruse |
| 8,225,892 | B2 | 7/2012 | Ben-Tzvi |
| 8,352,744 | B2 | 1/2013 | Kruse |
| 8,444,067 | B2 | 5/2013 | Schmon et al. |
| D692,530 | S | 10/2013 | Gehrung |
| D692,532 | S | 10/2013 | Li et al. |
| D698,008 | S | 1/2014 | Schmon et al. |
| D704,300 | S | 5/2014 | Li et al. |
| 8,757,182 | B2 | 6/2014 | Schmon |
| 8,857,732 | B2 | 10/2014 | Brose |
| 8,899,501 | B2 | 12/2014 | Fox et al. |
| 8,925,836 | B2 | 1/2015 | Dettlaff |
| D737,126 | S | 8/2015 | Tschan |
| D740,393 | S | 10/2015 | Gehrung |
| 2003/0213857 | A1 | 11/2003 | Schmon et al. |
| 2004/0177890 | A1 | 9/2004 | Weinmann |
| 2005/0145724 | A1* | 7/2005 | Blette ..... B05B 7/02 239/525 |
| 2005/0284963 | A1 | 12/2005 | Reedy |
| 2008/0029619 | A1 | 2/2008 | Gohring et al. |
| 2008/0272213 | A1* | 11/2008 | Ting ..... 239/461 |
| 2009/0026290 | A1* | 1/2009 | Fox ..... 239/345 |
| 2010/0206963 | A1 | 8/2010 | Huang |
| 2011/0127767 | A1* | 6/2011 | Wicks et al. ..... 285/319 |
| 2013/0056556 | A1 | 3/2013 | Schmon et al. |
| 2014/0145003 | A1 | 5/2014 | Schmon et al. |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 2126957 | | 1/1995 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CN | 1909970 | | 2/2007 |
| CN | 1917960 | | 2/2007 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| DE | 3016419 | | 8/1987 |
| DE | 3016419 | C2 | 8/1987 |
| DE | 3742308 | | 6/1989 |
| DE | 4321940 | | 1/1995 |
| DE | 19516485 | | 11/1996 |
| DE | 19727884 | | 2/1999 |
| DE | 19824264 | | 12/1999 |
| DE | 19958569 | | 2/2001 |
| DE | 10031857 | | 1/2002 |
| DE | 10031858 | | 1/2002 |
| DE | 10135104 | | 9/2002 |
| DE | 10 2004 027789 | | 2/2005 |
| DE | 2004027789 | A1 | 2/2005 |
| DE | 102004003439 | | 8/2005 |
| DE | 102007039106 | | 2/2009 |
| DE | 102007052067 | | 5/2009 |
| DE | 202010012449 | | 12/2010 |
| DE | 102010060086 | | 4/2012 |
| DE | 102011106060 | | 1/2013 |
| DE | 102011118120 | | 5/2013 |
| EP | 0631821 | | 1/1995 |
| EP | 0650766 | | 5/1995 |
| EP | 1106262 | | 6/2001 |
| EP | 1277519 | | 1/2003 |
| EP | 1299194 | | 4/2003 |
| EP | 1412669 | | 4/2004 |
| EP | 1479447 | A1 | 11/2004 |
| EP | 1708822 | | 10/2006 |
| EP | 1708823 | | 10/2006 |
| EP | 1718415 | | 11/2006 |
| EP | 1880771 | A1 | 1/2008 |
| EP | 1902786 | | 3/2008 |
| EP | 1964616 | A2 | 9/2008 |
| EP | 2027931 | | 2/2009 |
| EP | 2106298 | | 10/2009 |
| EP | 2111920 | | 10/2009 |
| EP | 2490819 | | 8/2012 |
| EP | 2576079 | | 4/2013 |

(56) References Cited

FOREIGN PATENT DOCUMENTS

| | | | |
|---|---|---|---|
| EP | 2608890 | | 7/2013 |
| FR | 2927824 | A1 | 8/2009 |
| HK | 1100405 | | 6/2009 |
| HK | 1096057 | | 7/2009 |
| HK | 1125067 | | 8/2012 |
| HK | 1138533 | | 11/2012 |
| JP | 58-119862 | | 5/1983 |
| JP | H08196950 | | 8/1996 |
| JP | 2003088780 | | 3/2003 |
| TW | 491092 | | 6/2002 |
| TW | I220392 | | 8/2004 |
| TW | I303587 | | 12/2008 |
| TW | I309584 | | 5/2009 |
| WO | 0202242 | | 1/2002 |
| WO | 03069208 | A1 | 8/2003 |
| WO | 2009056424 | | 5/2009 |
| WO | 2011047876 | | 4/2011 |
| WO | 2011147555 | | 12/2011 |
| WO | 2012119664 | | 9/2012 |
| WO | 2013000524 | | 1/2013 |

OTHER PUBLICATIONS

English translation Written Opinion published Jun. 13, 2013 for PCT/EP2011/005842.
English translation of International Search Report (ISR) published Jun. 7, 2012 for International Patent Application No. PCT/EP2011/005842 filed Nov. 19, 2011.
Notice of Allowance dated Aug. 3, 2015 for U.S. Appl. No. 29/486,232.
Application filed Jul. 31, 2015 for U.S. Appl. No. 14/815,210.
Final Office Action dated Aug. 4, 2015 for U.S. Appl. No. 13/380,949.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
Printout from Internet www.ehow.com explaining how to choose a spray gun and stating in item 2 "Nozzle sizes vary between about 1 mm and 2 mm.", printed Sep. 7, 2012.
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012.
Printout from Internet of pages from brochure of Walther Pilot showing nozzle sizes for spray guns ranging from 0.3 mm to 2.5 mm, dated 2007.
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012.
Printout from Internet of p. 28 from current 3Mtm brochure showing Tip/Nozzle/Air Cap Selection Guide with nozzle sizes from 0.5 mm to 3.0 mm.
Decision by EPO regarding opposition proceedings to revoke patent No. 99926841.0-2425/ 1108476, corresponding to '387 patent, 2012.
SATA News Publication Dan-Am Jul.-Sep. 1996.
SATA News Publication Dan-Am Oct.-Dec. 1996.
SATA News Publication Dan-Am Apr.-Jun. 1998.
Dan-Am SATA Catalog 6 for spray guns 1991.
Dan-Am SATA Catalog 8 for spray guns 1994.
Dan-Am Catalog 6—51pp published 1991.
Japanese Industrial Standards B 9809 English translation, 1992.
Japanese Industrial Standards B 9809 revised Mar. 1, 1991.
SATA News, vol. 21, 2009.
Collision Hub TV Document (image from video clip) printed Oct. 9, 2013.
MyRielsMe.com document from press release printed Oct. 9, 2013.
How to set Air pressure, Utube screenshot printed Oct. 9, 2013.
Ohio EPA Lefty to Tony Larimer, response to letter dated Aug. 2006.
Pinahs Ben-Tzvi et al, A conceptual design . . . , Mechatrronics 17 (2007) p. 1-13.
On line ad from Amazon.com printed Oct. 14, 2013.
Rone et al, MEMS-Baed Microdroplet Generation with Integrated Sensing, COMSOL, 2011.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Response filed Dec. 21, 2015 to Office Action dated Jul. 20, 2015 for U.S. Appl. No. 14/113,649.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.californiasteel.com/GetPublicFile.aspx?id=53.
Office Action dated Feb. 19, 2016 for U.S. Appl. No. 14/113,649.
Notice of Allowance dated Jan. 27, 2016 for Design U.S. Appl. No. 29/510,723.
Office Action dated Dec. 31, 2015 for U.S. Appl. No. 14/572,998.
Notice of Allowance dated Jan. 19, 2016 for Design U.S. Appl. No. 29/539,615.

* cited by examiner

SPRAY GUN AND ACCESSORIES

FIELD OF THE INVENTION

The invention pertains to an easily cleanable spray gun.

BACKGROUND OF THE INVENTION

Spray guns for paints, lacquers, adhesives or other flowable materials require careful cleaning of the material-conducting areas after each use or before each change of material, if a cartridge, i.e. exchangeable inserts, preferably designed as a disposable item, is not used for material conduction. Such an advantageous spray gun with a handle region and with a head equipped with a cartridge, wherein the cartridge has an inlet area for a material-conducting channel that ends in an outlet area and wherein the inlet area of the cartridge is or can be connected to a supply container for the material to be sprayed and wherein the cartridge preferably guides at least one material-conducting component of the spray gun, is known from DE 3016419 C2, for example. This spray gun has a divided head with an area at the rear and an area located at the front in the spraying direction. The rear end of the front area of the divided head is equipped with a plug-in receptacle for a cartridge having a tubular material-conducting channel extending in the spray jet direction, in the interior of which a nozzle or paint needle is arranged. The nozzle can be moved backward and forward in the spray jet direction by means of a lever and spring mechanism, so that the material to be sprayed can pass through a nozzle arranged in the outlet area for processing. The cartridge is retained in the head by means of plug pin connections. After use, the pin connections can be detached, the two head areas can be folded apart from one another, the cartridge including the paint needle can be removed from the head and can then subsequently discarded. Then a new cartridge can be mounted on or in the spray gun. Cleaning the material-conducting areas of the spray gun is unnecessary in this case. The pin connections are relatively complicated, however, difficult to create and release and also do not always guarantee problem free operating safety.

SUMMARY OF THE INVENTION

One aspect of the invention is to create a spray gun of the type mentioned above that operates reliably at all times and to which or in which a cartridge in particular, or some other type of interchangeable insert, can be mounted in a less complicated manner but securely, and can be detached therefrom. Another aspect of the invention is also to create an improved mounting means for cartridges or inserts in spray guns. A further aspect of the invention is to achieve an optimally good spraying result with the aid of an air distributor.

BRIEF DESCRIPTION OF THE INVENTION

Exemplary embodiments of the invention will be explained below with reference to the figures. Therein:

Figure 3:
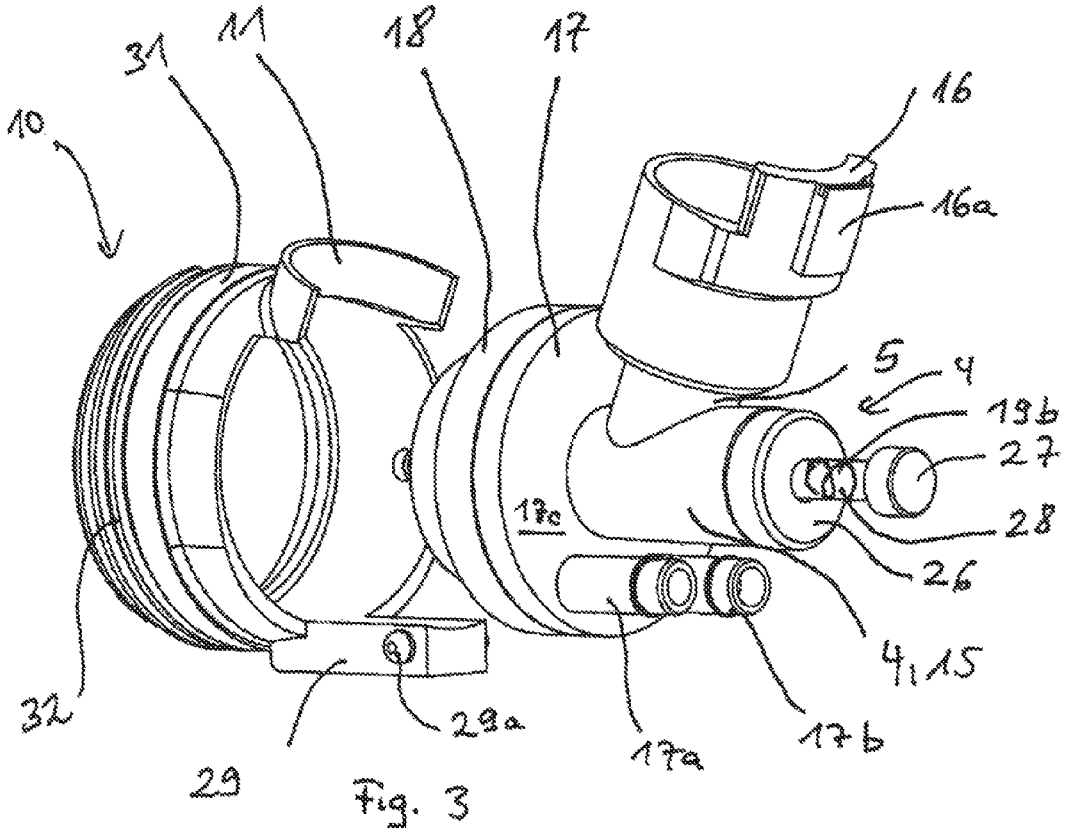
Figure 3A:
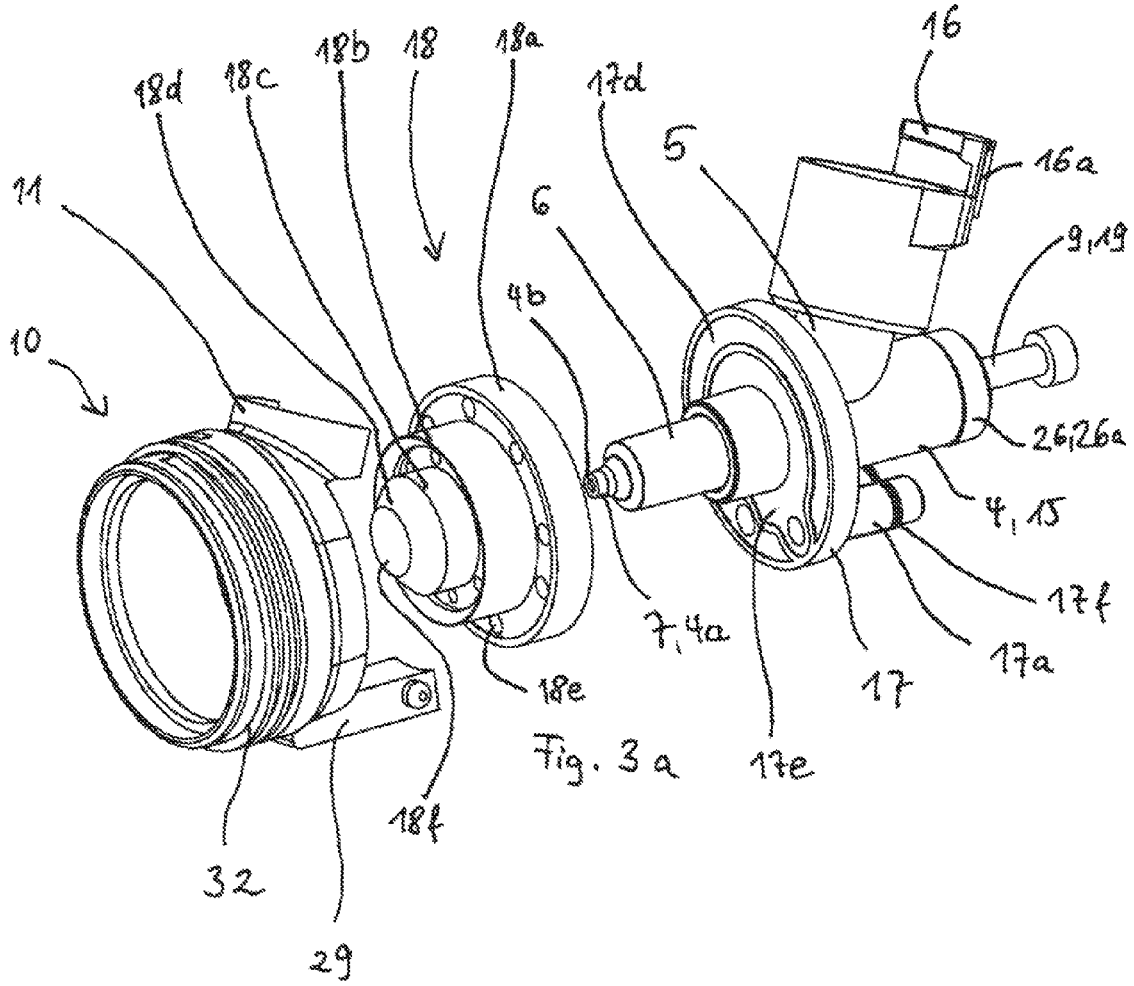
Figure 4:
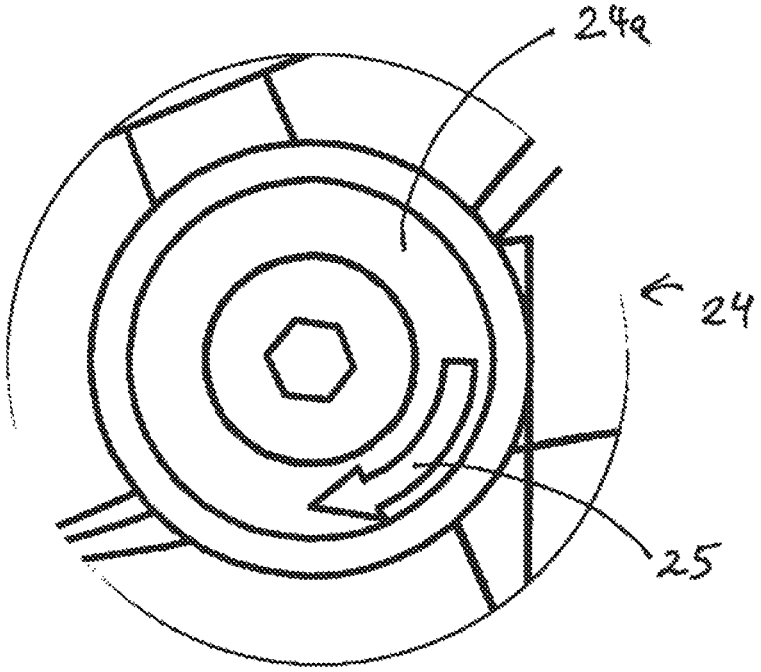
Figure 4A:
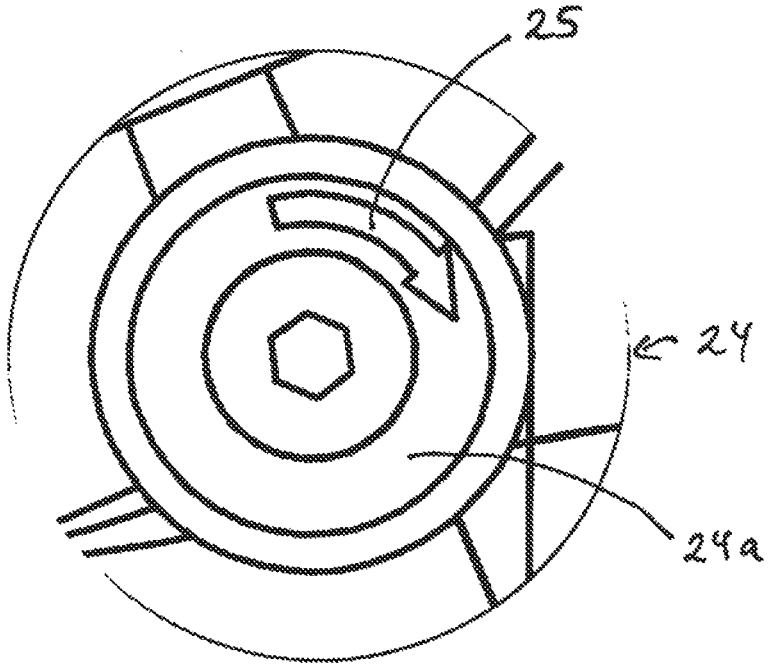
Figure 5:
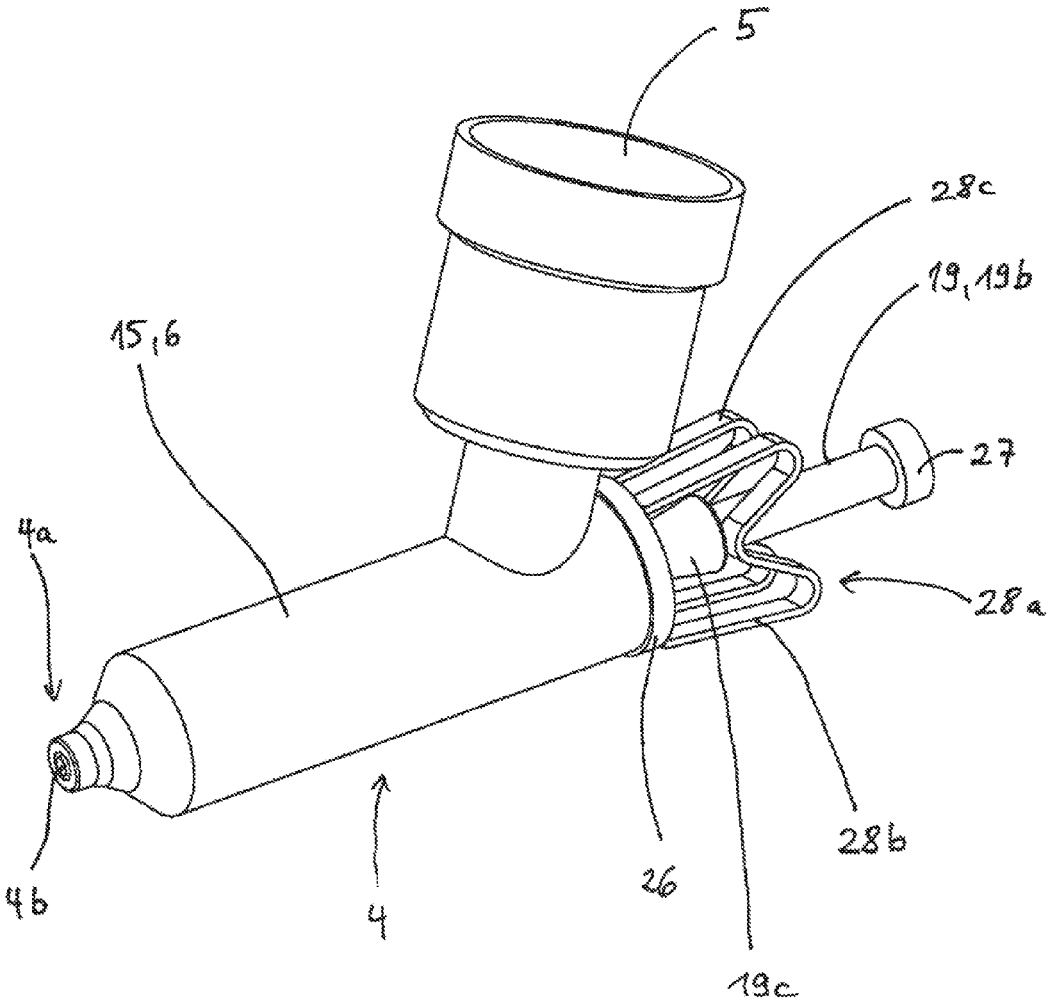
Figure 5A:
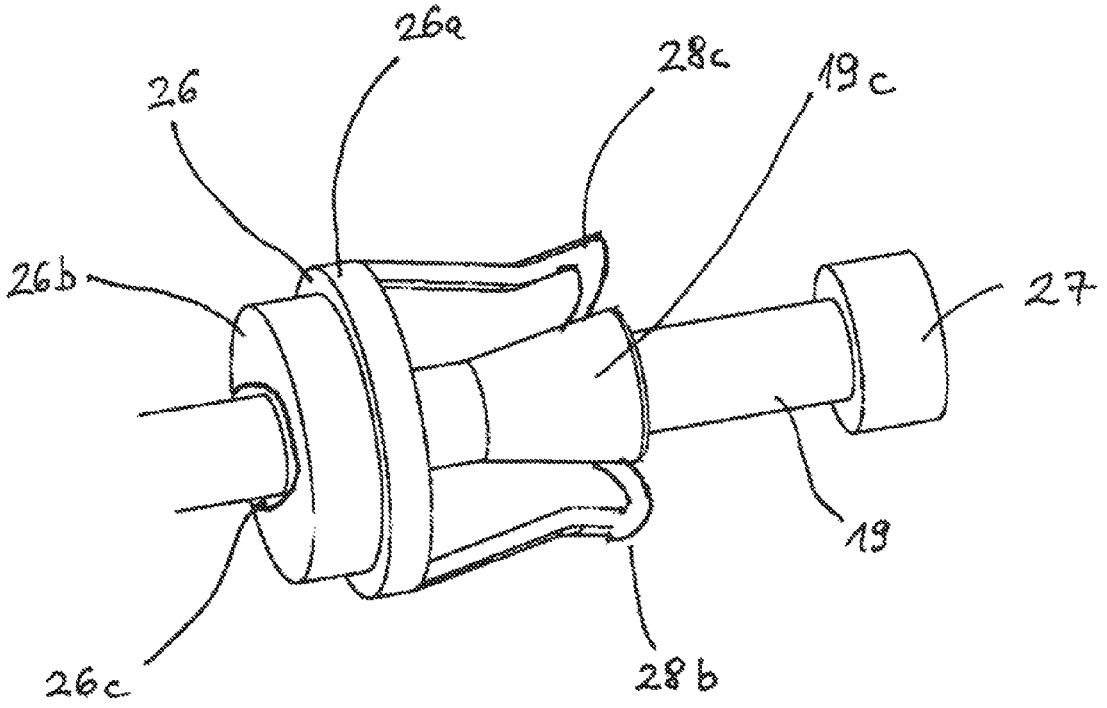
Figure 5B:
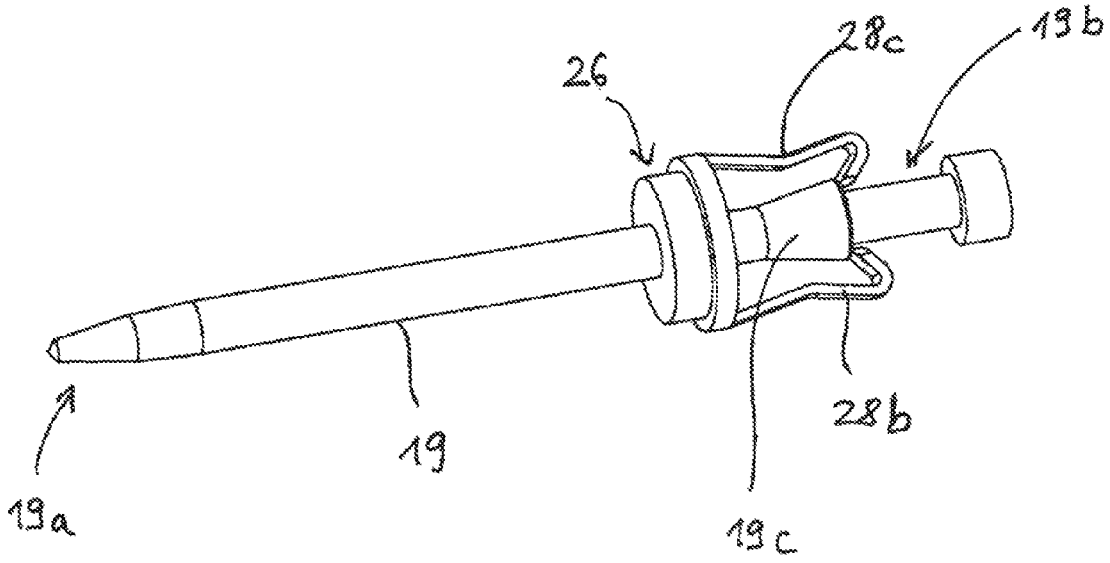
Figure 5C:
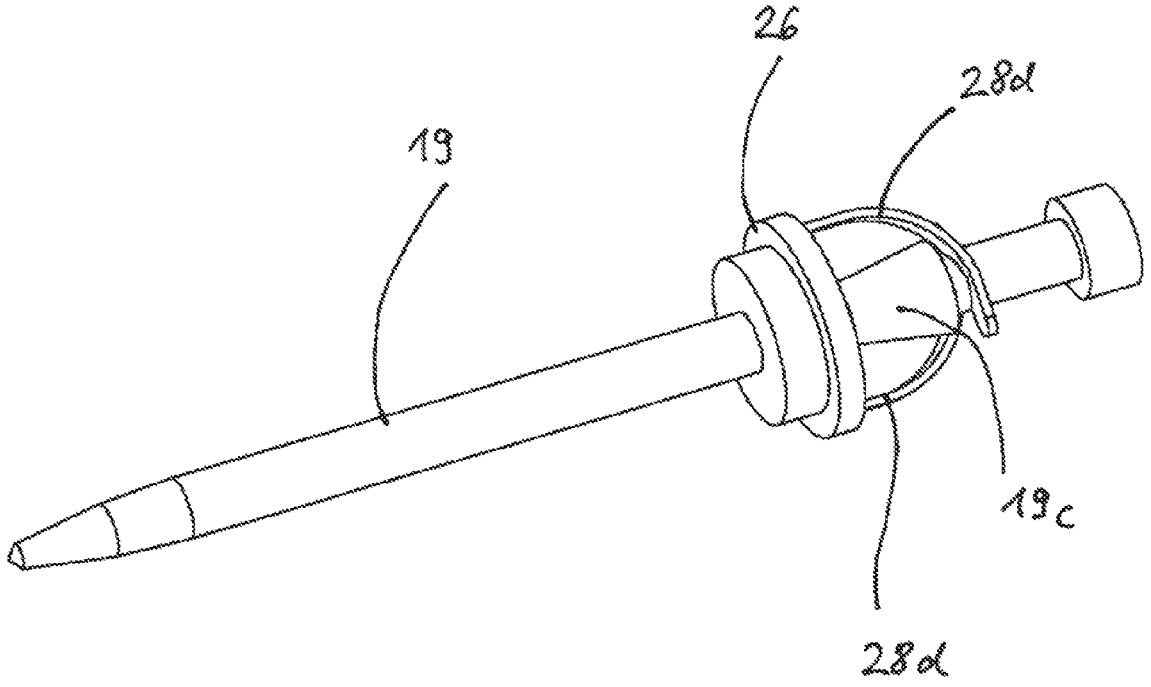
Figure 5D:
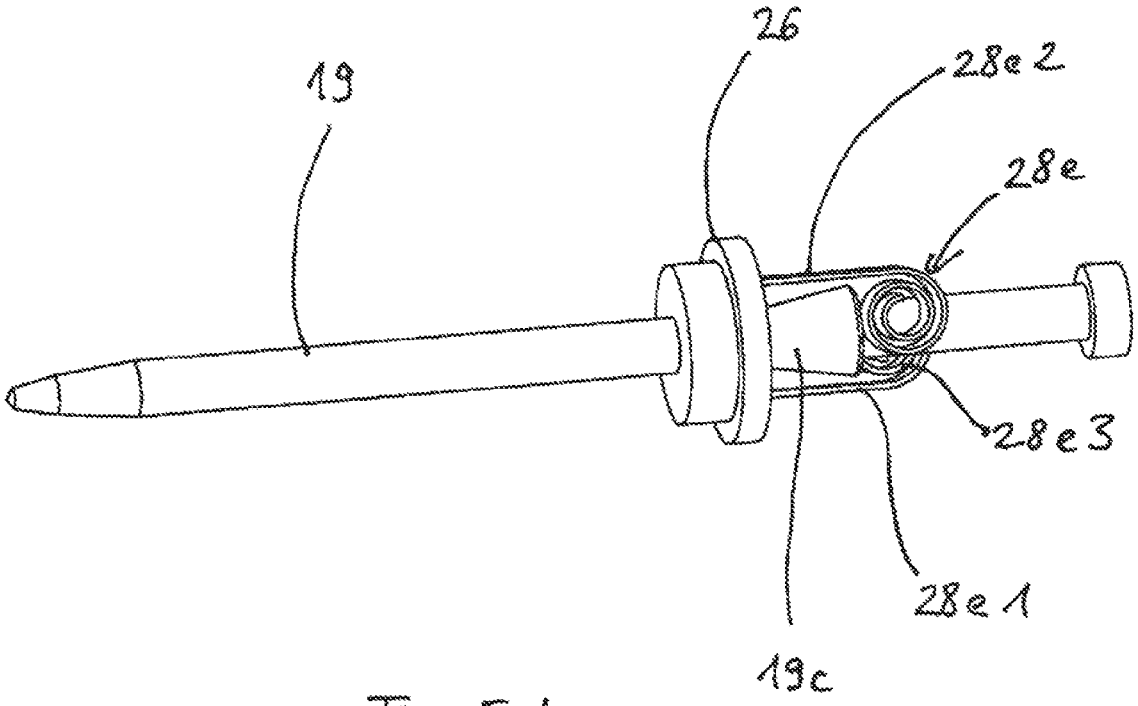
Figure 5E:
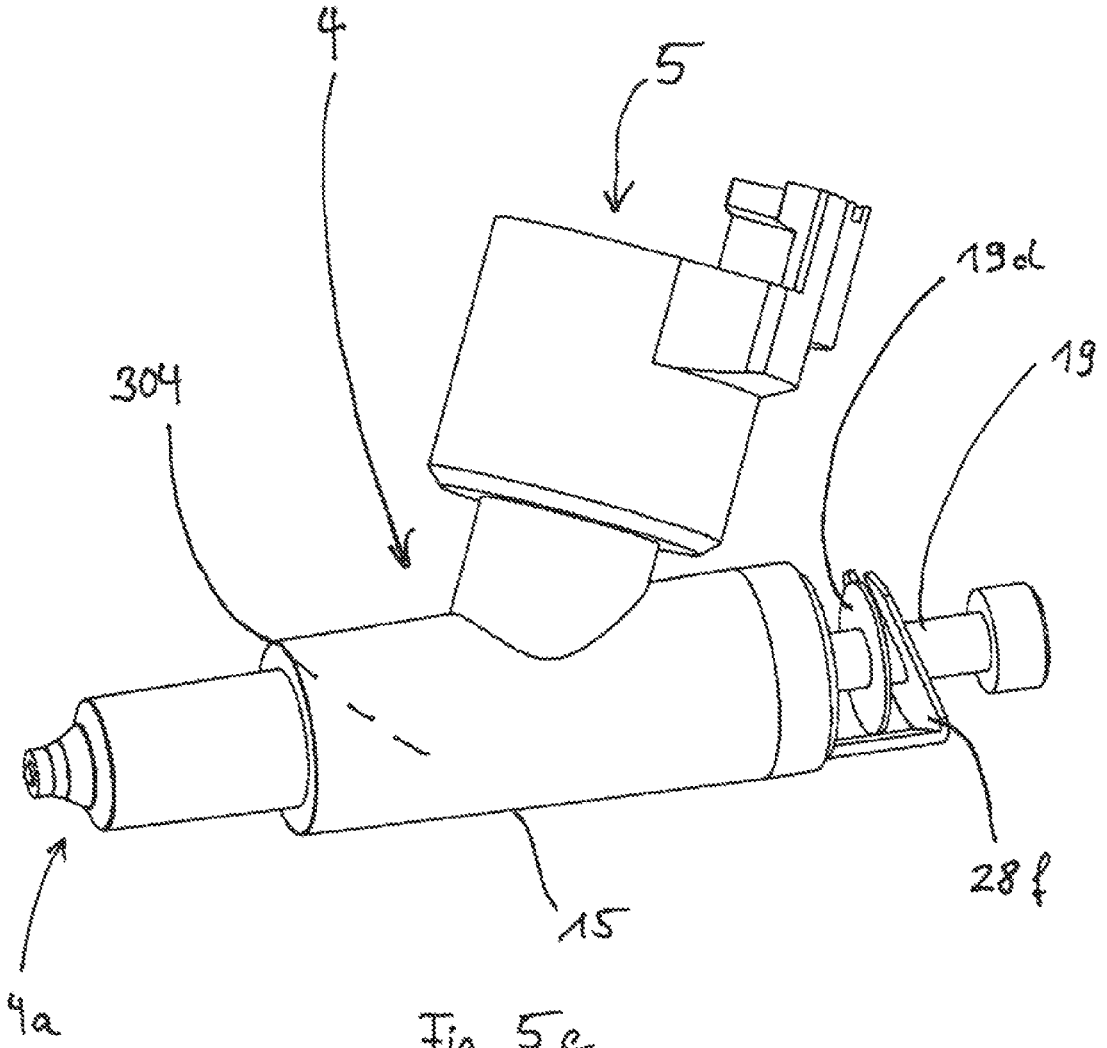
Figure 6:
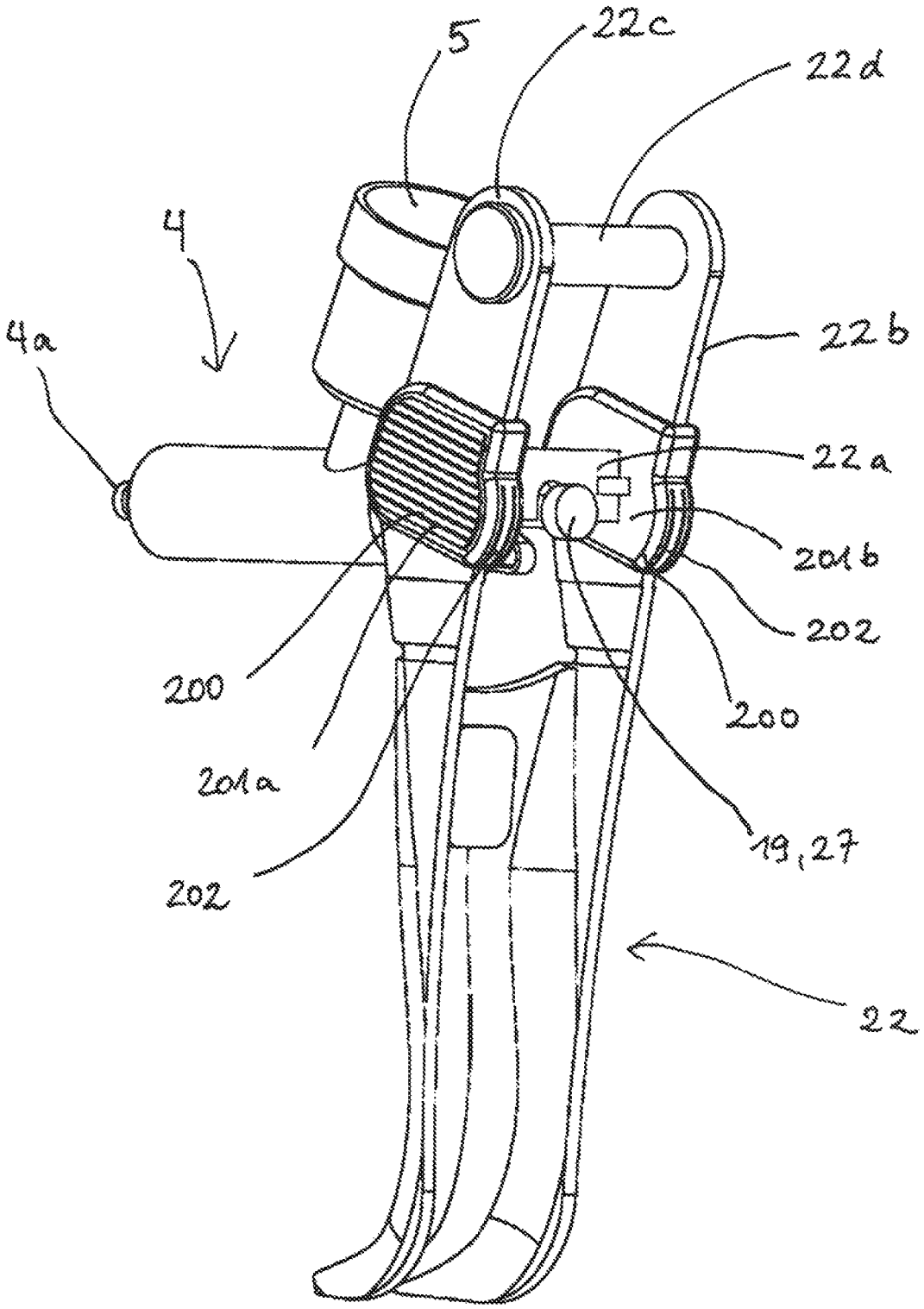
Figure 7:
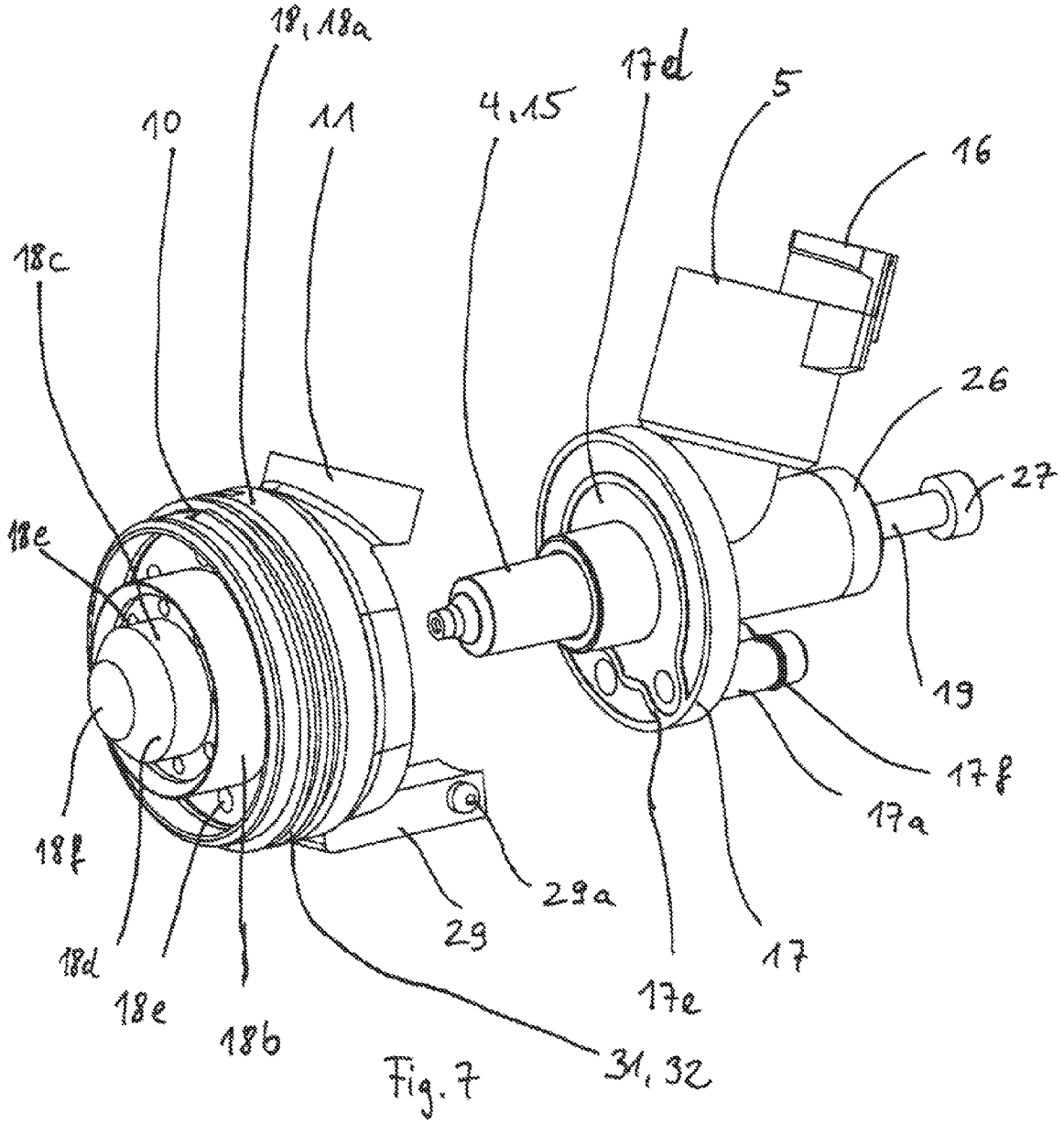
Figure 8:
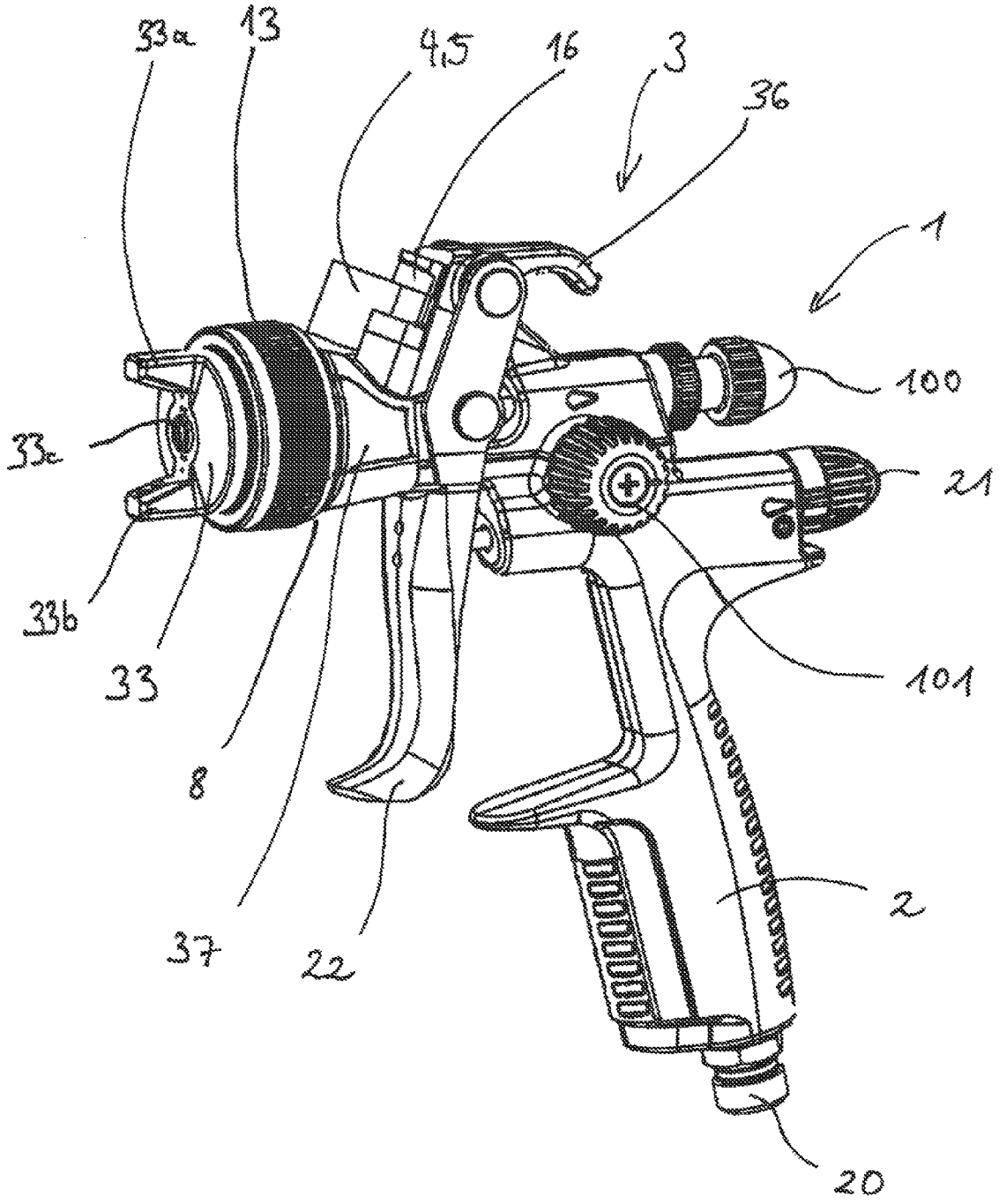
Figure 9:
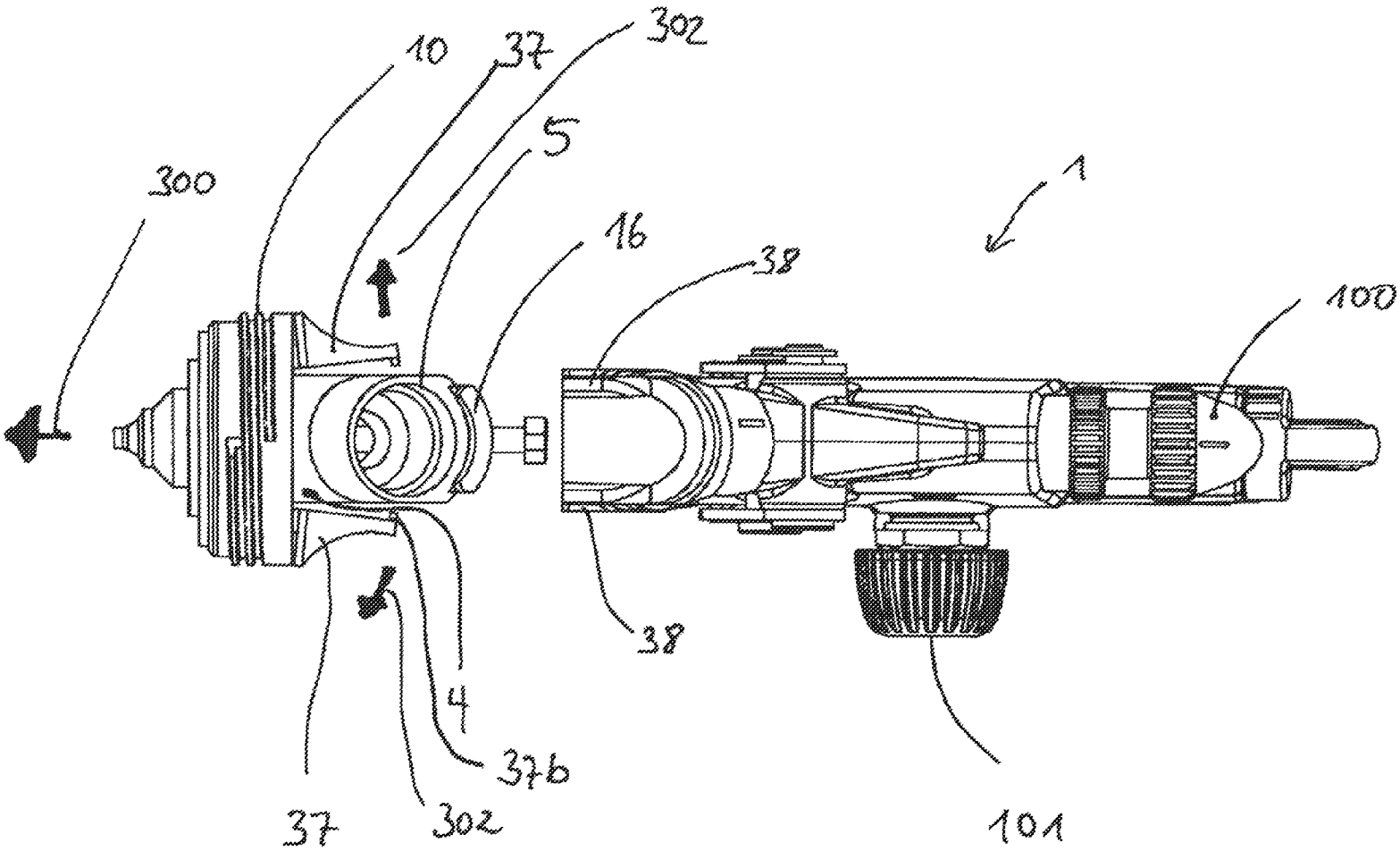
Figure 10:
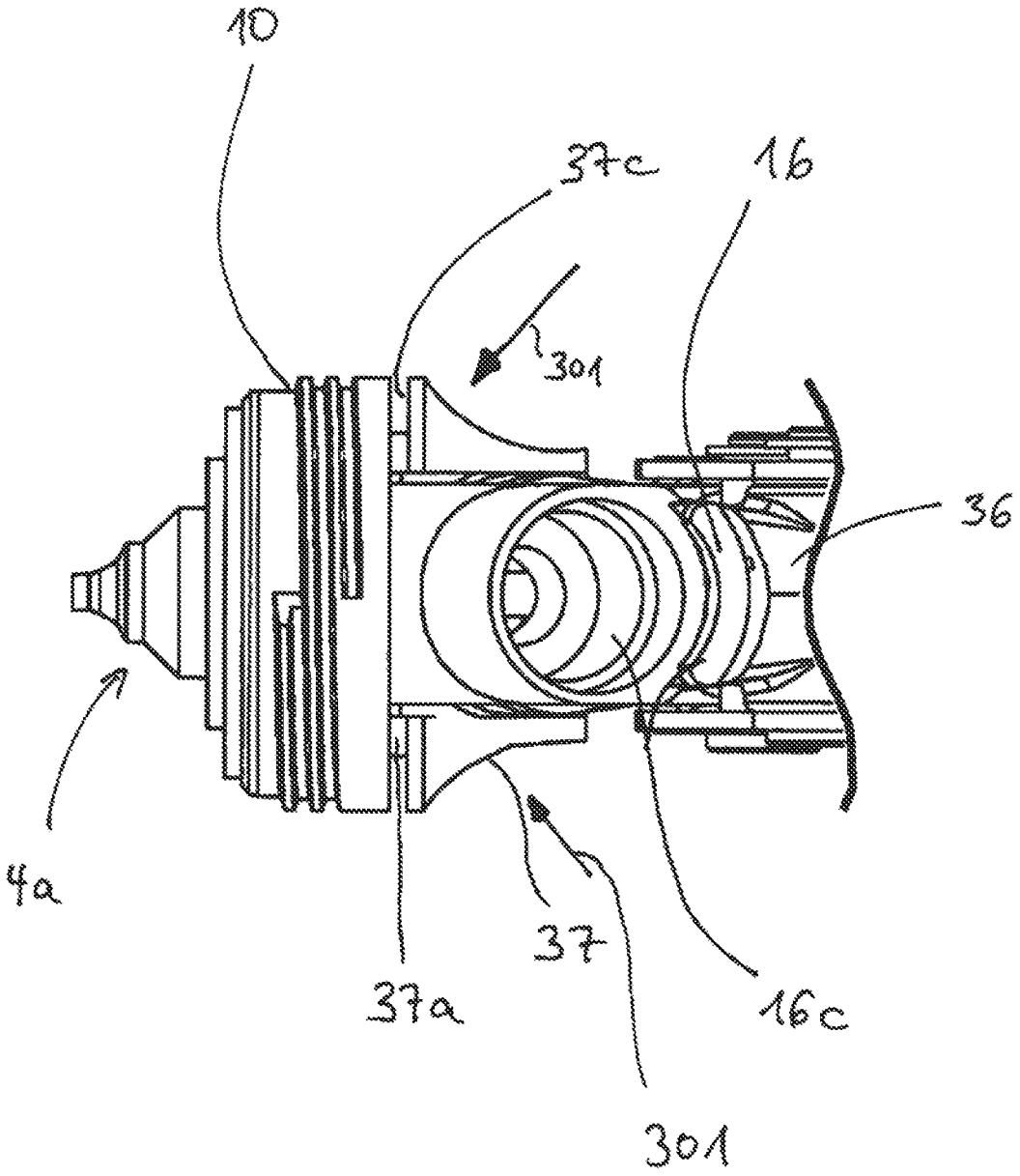
Figure 11:
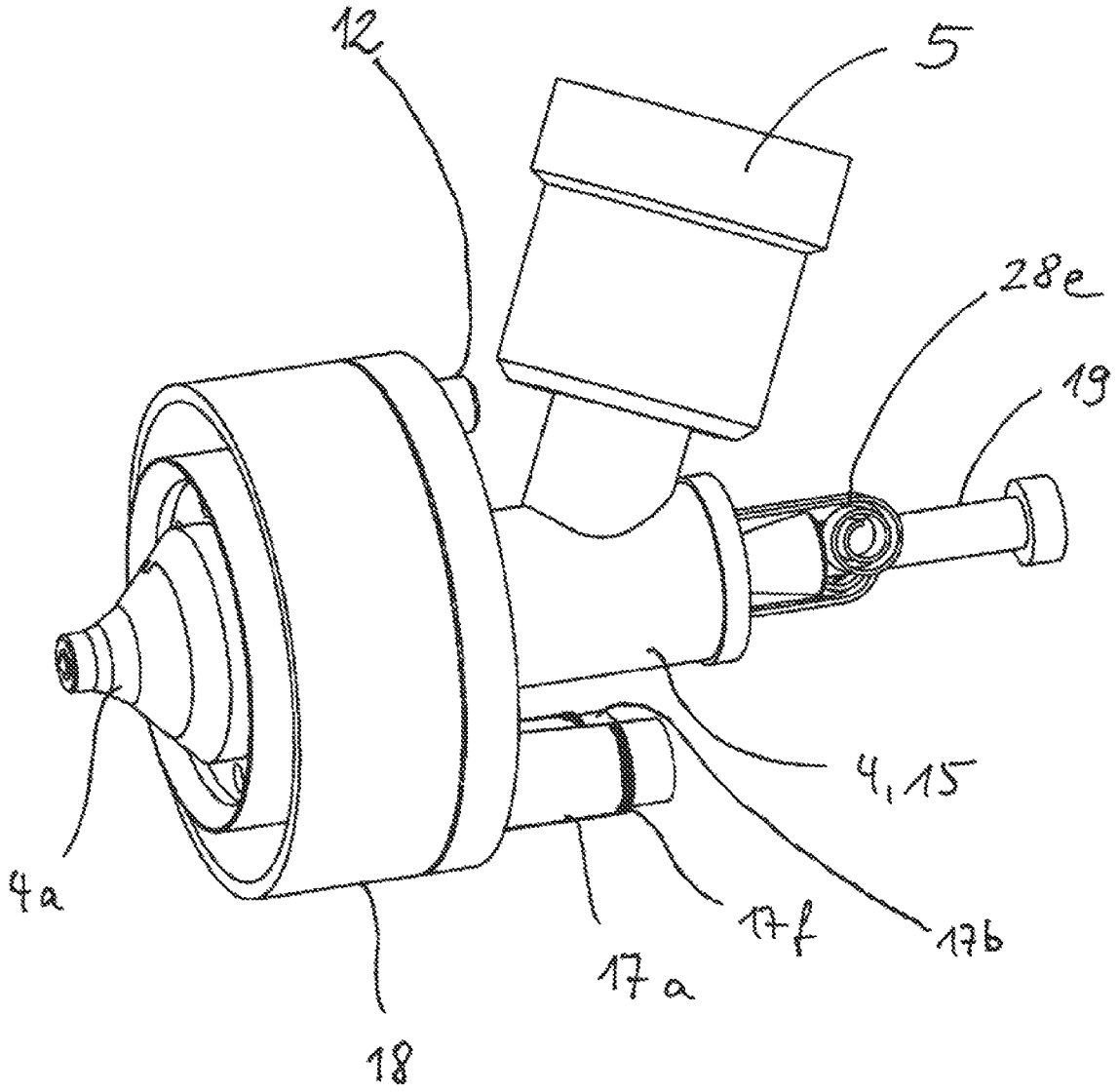
Figure 12:
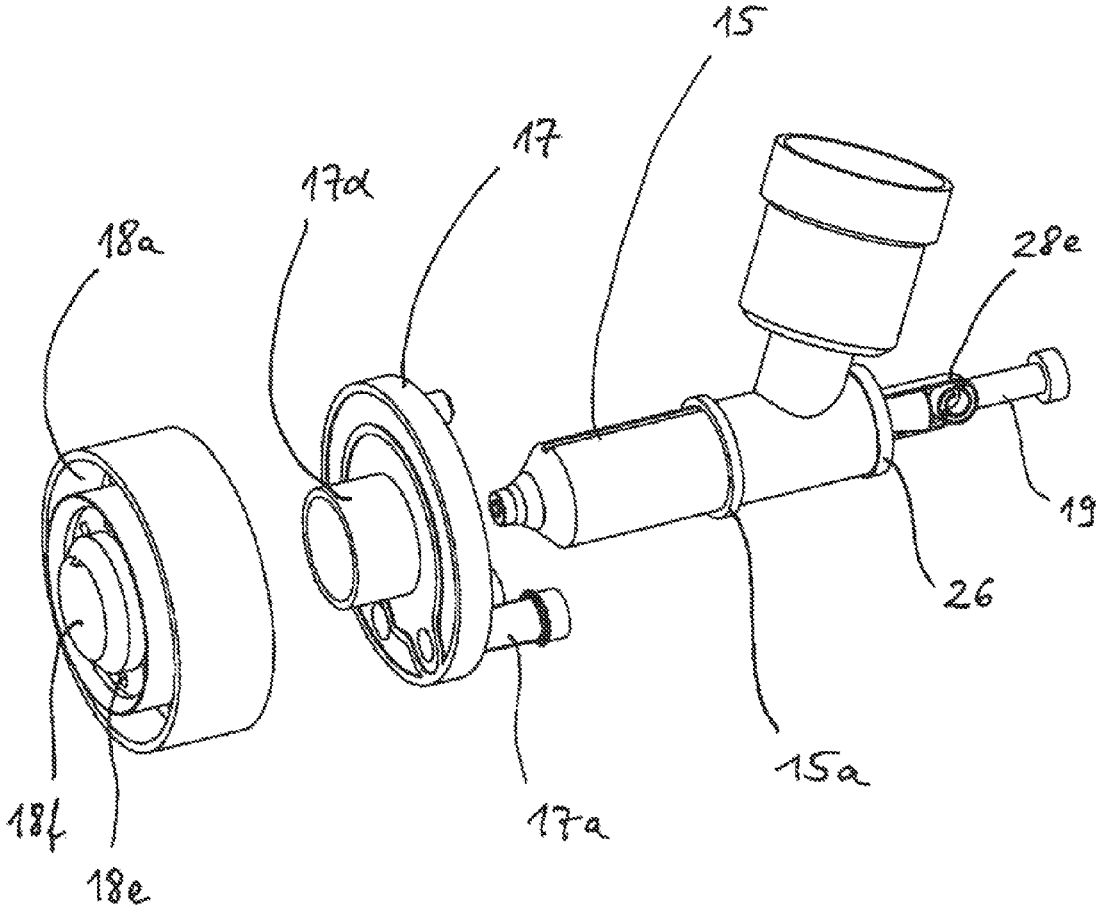
Figure 13:
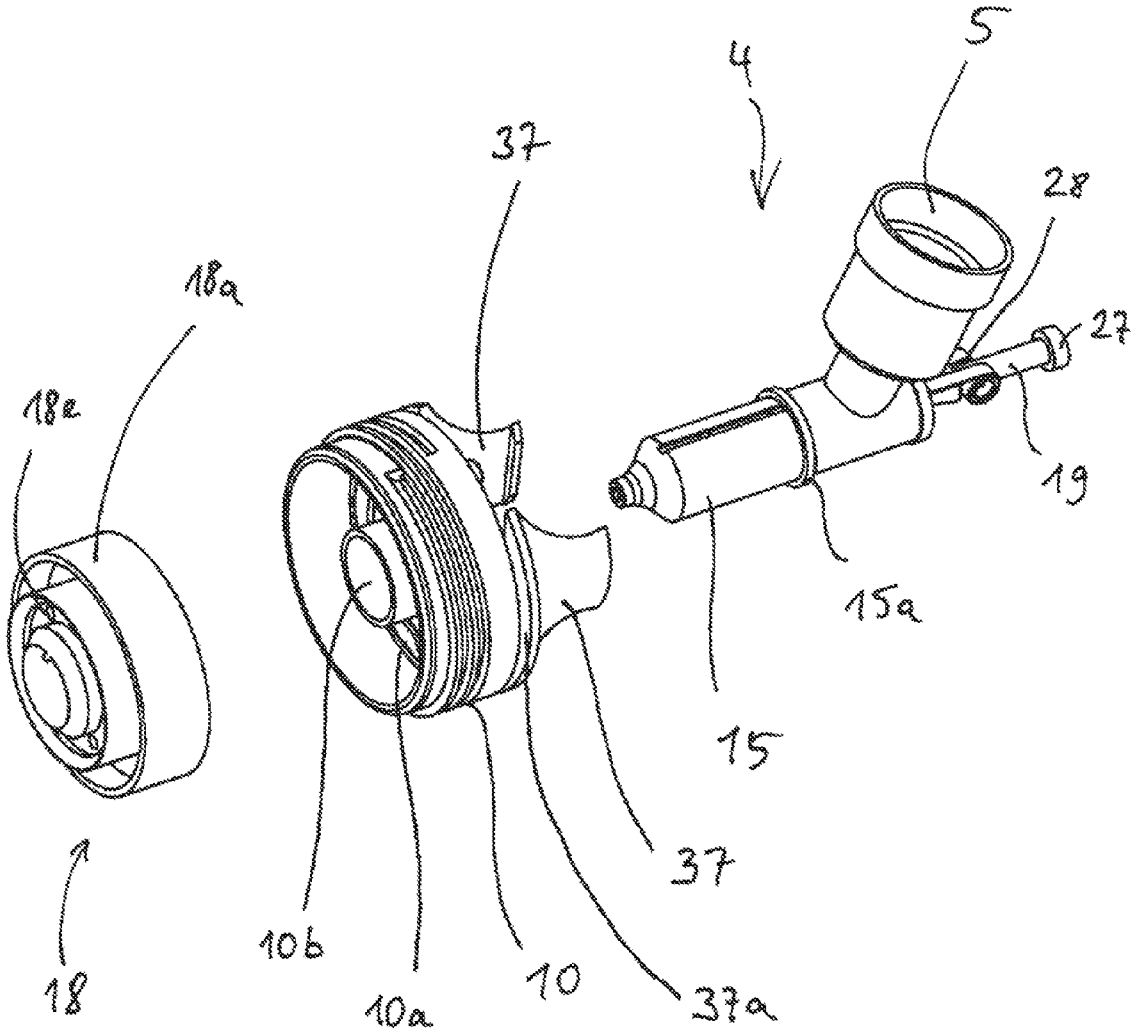
Figure 14:
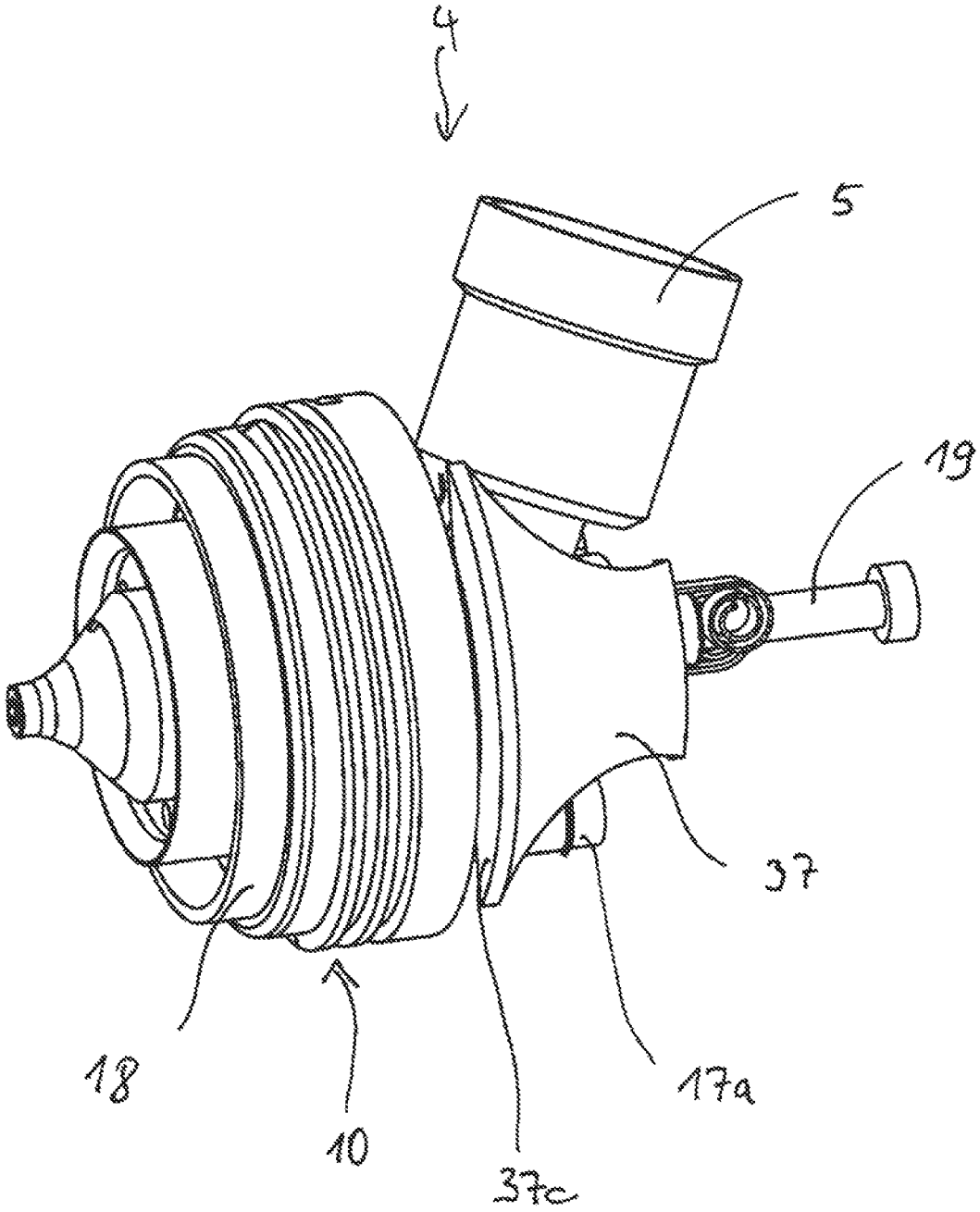
Figure 15:
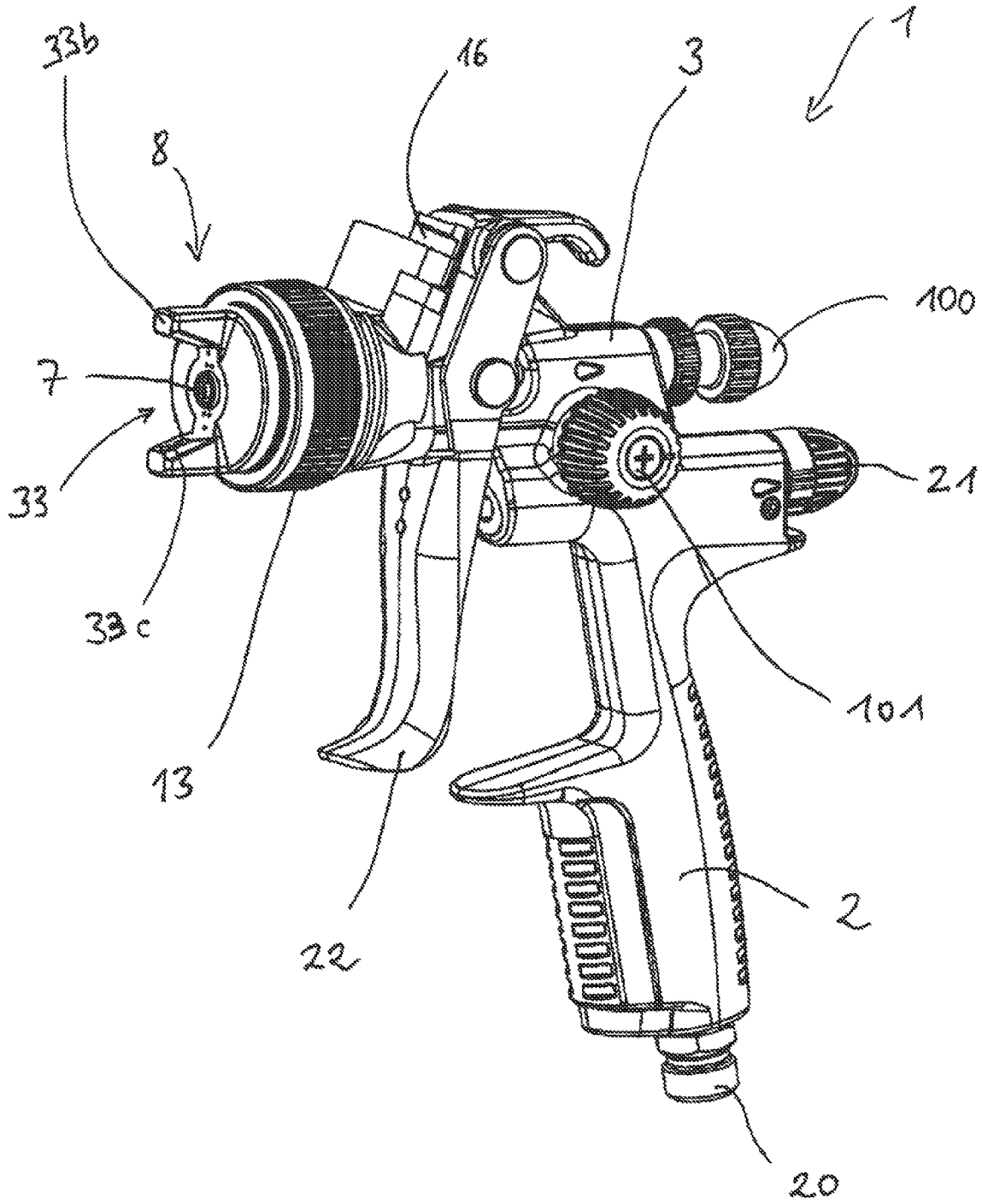
Figure 16:
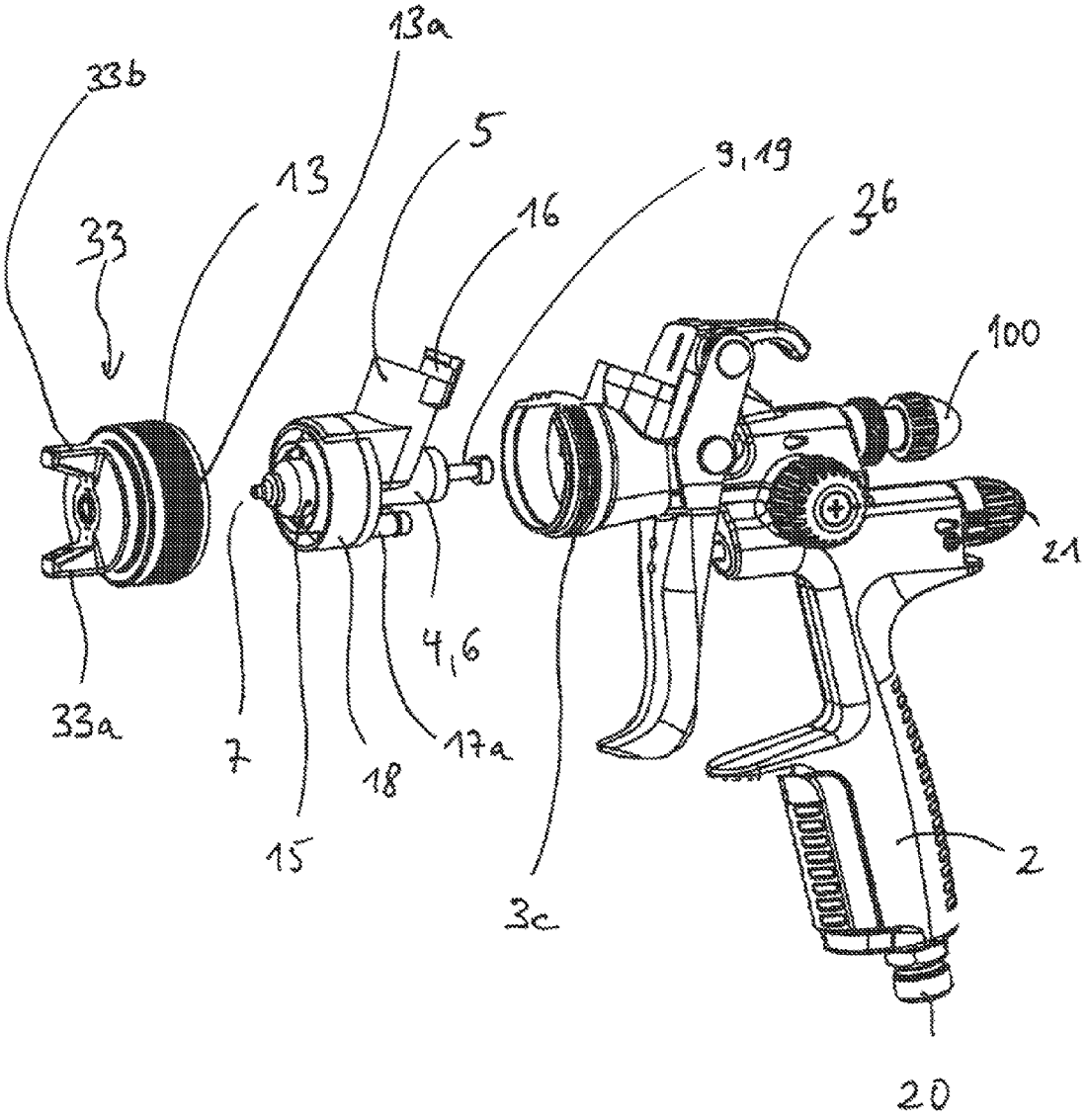

FIGS. 3 and 3*a* show details of the first spray gun in different perspective views, FIGS. 4 and 4*a* show additional details of the first spray gun in different operating positions, FIG. 5 shows a first cartridge according to the invention in a perspective view, FIGS. 5*a* through 5*e* show details and variants of FIG. 5, FIG. 6 shows the cartridge of FIG. 5 in the partially assembled state, likewise in perspective view, FIG. 7 shows a second cartridge according to the invention in a perspective view, FIG. 8 shows a second spray gun according to the invention in a side view, FIG. 9 shows the spray gun of FIG. 8 in a top view in the unassembled state, FIG. 10 shows a second cartridge according to the invention in a plan view, FIGS. 11 and 12 show the cartridge according to the invention as in FIG. 5*d* in combination with other details, in the assembled and unassembled state in a perspective view, FIGS. 13 and 14 show the cartridge according to the invention as in FIG. 5*d* in combination with different details, in the assembled and unassembled state in a perspective view, and FIGS. 15 and 16 show a third spray gun according to the invention in the assembled and unassembled state.

DETAILED DESCRIPTION OF THE INVENTION

Figure 1:
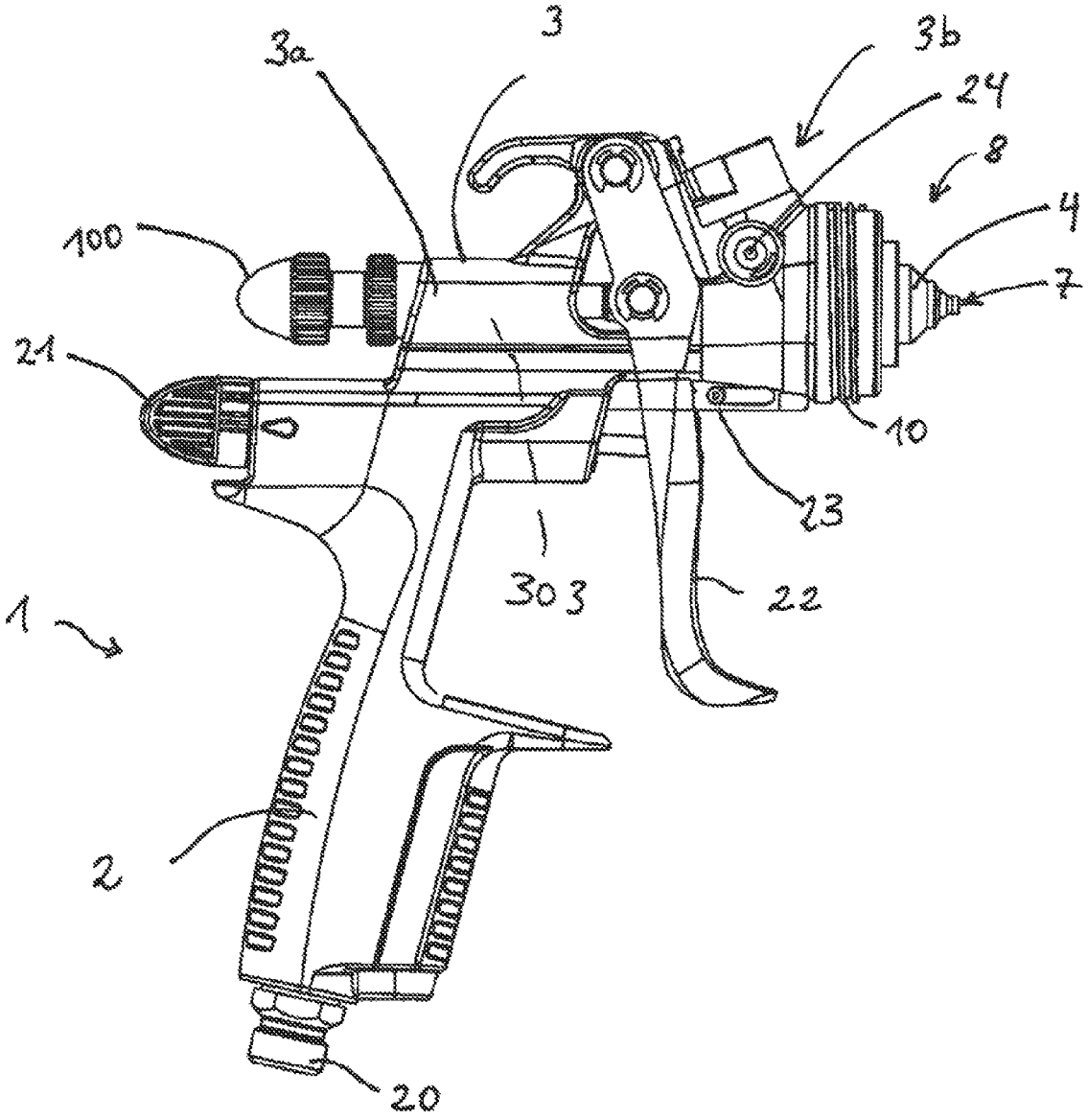
FIG. 1 shows a first spray gun according to the invention in a side view.
Figure 2:
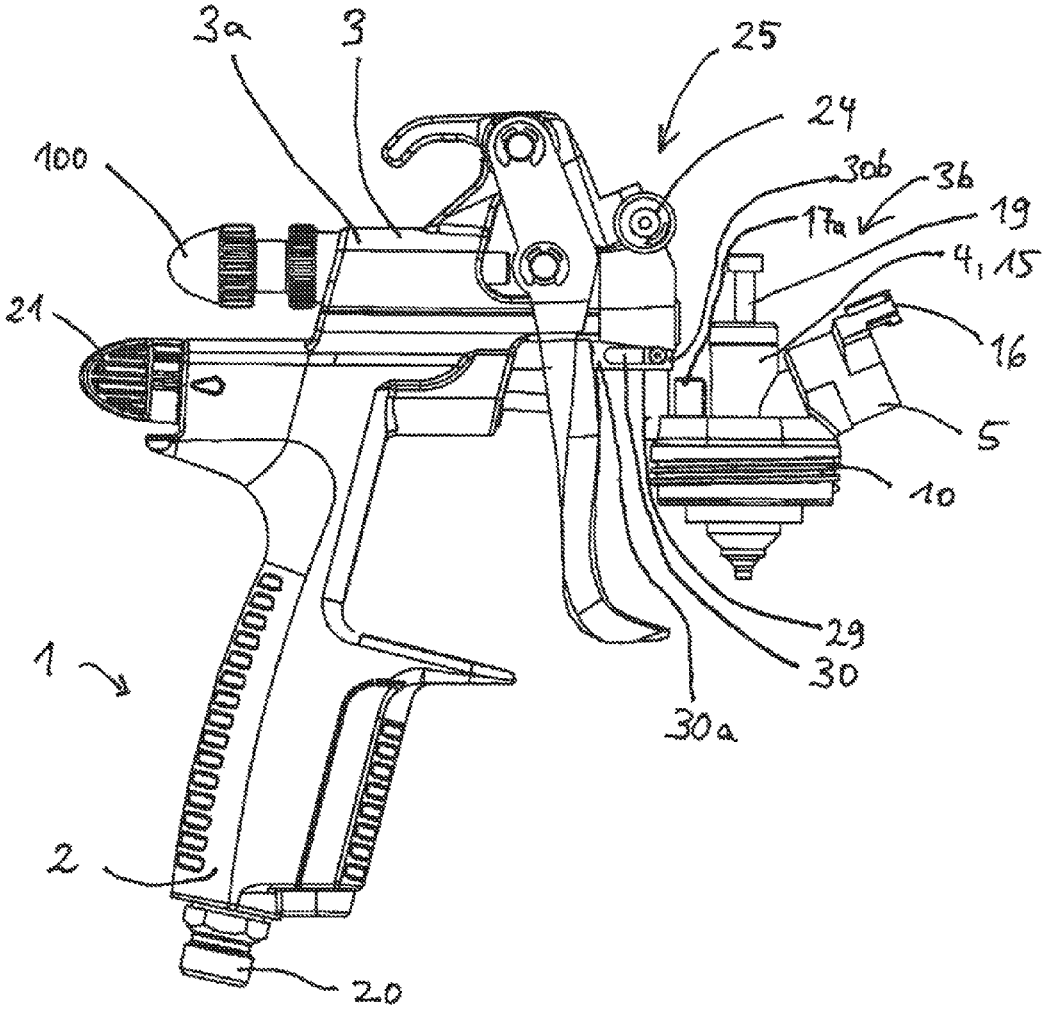
FIG. 2 shows the first spray gun in a different operating state.

The spray gun according to FIGS. 1 and 2 is a paint spray gun and has a gun body 1 with a handle area 2 and a head 3. These two subsections 2 and 3 run at an angle of approximately 100° relative to one another, as is usual. The handle area 2 has a compressed air connection 20 at its lower end. A number of air channels (to be discussed later), which end at the front end 8 of the spray gun head 3, extend from the compressed air connection 20 through the handle area 2 and through the head 3. The amount and pressure of air flowing through these air channels can be regulated in the usual manner by means of an air micrometer 21. The front end 8 of the head 3 can additionally be equipped with an air nozzle, which can have projecting horns with openings (not shown). It goes without saying that the spray gun can be further equipped with additional more or less typically designed nozzle rings or the like, which will be discussed below.

The material to be sprayed is conducted through the front end 8 of the spray gun head 3. When the spray gun is not in operation, the front end 8 of the head 3 is closed by a mechanism that will be discussed at a later point. The mechanism can be operated by means of a so-called trigger bar 22; the quantity of material can be regulated by a device of which only a regulation screw 100 with a lock nut is shown here.

In the present embodiment, the head 3 of the spray gun is designed in two parts. The head 3 has a rear end 3*a*, which is non-detachably connected to the handle area 2 of the spray gun, and a front end 3*b*, which is mounted on the rear end 3*a* via an articulation 23 so as to be foldable off or away. In the present embodiment, the articulation is constructed as a rotary joint. The rotary joint 23 can be actuated by means of a control button 24, which is shown in detail in FIGS. 4 and 4*a*. The control button 24 is a rotary button, which is shaped in the form of a truncated cone in the present example. The button 24 is equipped with an arrow 25 on its surface 24*a* facing away from the operator. The arrow 25 indicates the state of the joint 23 or the foldable part 3*b* of the spray gun head 3; FIG. 4 shows the "locked" position and FIG. 4*a* shows the "unlocked" position.

The material to be sprayed is conducted in the spray gun according to the invention by means of a cartridge 4, of which one embodiment can be seen especially clearly from FIGS. 3 and 3*a*. The cartridge 4 is produced, in particular injection-molded, from an inexpensive plastic. It has a first area 15, which is designed in the present example as a hollow cylindrical tube. In the present embodiment, an area likewise constructed as a hollow cylindrical tube 5, which can be connected to a storage container for the material to be sprayed for example, projects at an angle from this area 15 of the cartridge 4. The hollow cylindrical tube 5 is used as an inlet area for the paint or other flowable materials into the spray gun or into the cartridge 4. The storage container could be a conventional gravity-fed flow cup, known as an "upside down cup," a bag or the like. In the present embodiment, the tube 5 has a projecting mounting bracket 16 for such cups at its free end.

The mounting bracket 16 extends over roughly half the circumference of the tube 5, is roughly half as high as the latter and has on its outer side a substantially quadrilinear connecting rail 16*a*, which enables a particularly simple but secure mounting and easy detachment of a cup from the spray gun with or without an intervening adapter, the cup or the adapter having a corresponding trough-shaped mating element for the connecting rail 16 that can be pushed into or over the connecting rail 16*a*. A connection via projections of this type is particularly secure because the components are guided over a large length.

This mounting bracket 16 or a different bracket arranged on the inlet tube 5 can also be used in other cases for supporting the cartridge 4 on the spray gun (cf. FIGS. 8-10).

It is further possible to connect a hose or the like leading to a pump, a pressure container, a pressure cup or some other container to the tube 5. Suspended cups (suction cups) and so-called side cups can likewise be used as supply containers; the tube 5 of the cartridge 4 need only be oriented in a different position for this purpose.

It is also possible, however, to construct the supply container and the cartridge as a one-piece component.

The tube 5 can of course also be constructed differently than described above. The connecting rail 16*a* can be replaced by a trough and a connecting rail on the supply container or provided on an adapter, a hose or the like. Instead of the connecting rail, the cartridge can have a catch tab, which enables a snap connection directly or indirectly via an adapter to the supply container or a hose or the like, in which case it goes without saying that a catch hole, catch groove or the like must be provided on the other component. Conversely, it is of course also possible to provide a catch hole or catch groove on the tube 5 and a catch tab or the like on the other component. In a different configuration, the tube 5 can also comprise a threaded connection having a full thread or a thread segment extending over approximately 180° for example. Especially in the latter case, the assembly and disassembly of the cartridge and the supply container or material supply is easily accomplished manually by rotating the components oppositely to one another. If catch tabs or threaded segments are used, a type of bayonet connection results, which enables particularly easy manual handling.

On the other hand, the tube 5 can have a plug connection that is either clasped by the mating element of the supply container or engages with the mating element of the supply container. The latter case guarantees particularly securely that no paint or other material escapes at the connecting point between the cartridge and the supply container. A combination of a rotary and plug connection is likewise possible.

An intervening adapter can likewise have a plug connection, a threaded connection or the like.

A connection by means of clamps, pins or the like is also conceivable.

As follows at least implicitly from the above, it is not absolutely necessary that the contour of the tube 5 be round as shown; it can also be oval, quadrangular, i.e. in any desired shape; it merely need be matched to the contour of the connection to the supply container and/or the contour of the spray gun.

It goes without saying that the actual cartridge body, i.e. the tube 15, also need not necessarily be shaped cylindrically as shown. A conical shape, a cuboid shape or some other geometric shape, with or without a change in cross-section, is likewise possible. The shape need only be matched to the shape of the cartridge receptacle in the spray gun or vice versa. The cylindrical shape or a conical shape, however, is advantageous both for the actual cartridge tube 15 and also for the inlet tube 5, because no edges that could negatively impact the material flow are present in the interior of the tubes. A particularly good guidance of the paint needle is likewise possible with a cylindrical tube 15, as will be discussed later.

The cartridge 4 can be divided in the longitudinal direction or transversely, depending on the individual requirement. The two cartridge parts can be interlocked, glued, welded or fastened to one another in some other way.

A guide channel 6 for the material to be sprayed that ends in an outlet area 7 arranged at the front end 8 of the spray gun head 3 runs through the first area 15 of the cartridge 4, formed in the present embodiment substantially as a hollow cylindrical tube. The specific design of the outlet area 7 will be discussed later. A mounting disk 17, which is simply pushed onto the tube 15 in the present example, extends around the hollow cylindrical tube 15. If necessary, the retention of the disk 17 on the cartridge 4 can be secured by means of adhesive or by welding. The mounting disk 17 can also be integrally molded with the cartridge 4, however. Two connectors 17*a* and 17*b*, which exit from the fastening disk 17 at the surface 17*c* facing the rear area 3*a* of the spray gun, extend through the mounting disk 17 or away from the mounting disk 17. The connectors 17*a* and 17*b* are produced integrally with the mounting disk 17 in the present example.

In a different design, the connectors could also be inserted into corresponding openings of the mounting disk, glued or otherwise mounted thereon.

In a different configuration, the connectors could also be only through holes in the mounting disk.

The connectors 17*a* and 17*b* engage in a respective bore at the rear end 3*a* of the spray gun. In the present example, the connectors 17*a* and 17*b* are inserted into air channels of the spray gun. Each air channel is equipped with a sealing ring 17*f* or the like at its end facing the connectors 17*a* and 17*b*. The seals can also be arranged on the connectors themselves or the connectors can be formed in such a manner that they seal radially and or axially on their own. The connection between the cartridge 4 and the spray gun is thus tight at this point. The connectors 17*a* and 17*b* can also accomplish the retaining function for the cartridge 4 on their own. The retention is particularly secure because two connectors 17*a* and 17*b* are provided.

In another configuration, one or more connectors are used only for fastening the cartridge to the spray gun and are not also used for conducting air. They of course do not have to be hollow in this case. It is of course particularly advantageous if the connectors 17*a* and 17*b* are constructed hollow as proposed and contribute to the air guidance.

At its other surface 17*d*, the mounting disk 17 has a slotted guide 17*e* for accommodating an air distributor 18, which can have a mating sliding guide (not shown). After being slipped onto or mounted on the tube 15, an outstanding centering of the air distributor 18 on the cartridge 4 is guaranteed. It would be also possible, however, to retain the air distributor 18 by other means such as catch tabs, rails or the like. The air distributor 18 and the cartridge 4 could also be glued to one another, welded to one another or integrally produced or correspondingly connected to the mounting disk 17.

In the present embodiment, the air distributor 18 according to the invention is formed in a substantially truncated conical shape and has four areas 18*a*-18*d*. The areas 18*a*-18*d* become smaller in size in the injection direction. A plurality of circular air holes 18*e* are provided in the largest diameter area 18*a* immediately adjoining the mounting disk 17 and in the smaller area 18*b* thereabove. The two subsequent areas 18*c* and 18*d* have no air holes. It is also possible, however, to equip only one of the areas 18*a*-18*d* or all areas 18*a*-18*d* with a single air hole each, which can also be shaped non-circularly, in the form of a slot, for example. A uniform atomization of the material to be sprayed can be achieved with the circular air holes 18*e* as shown. The airflow can preferably be brought into the desired shape with a so-called air guide disk and/or other air guidance means.

In the center of the uppermost area 18*d* of the air distributor 18, a passage opening 18*f* for a paint needle 19 is provided, which will be discussed later.

The air distributor 18 according to the invention can of course also advantageously be used in any other spray gun, having a cartridge or not, due to its special design.

At its free end, the cartridge 4 has a substantially truncated-conical tip 4*a*. In the previously described first tubular area 15 of the cartridge 4, a material-conducting component 9, constructed in the present embodiment as a cylindrical paint needle 19, is contained in the material-conducting channel 6 and extends through the previously mentioned passage opening 18*f* in the air distributor 18 up to the truncated-conical tip 4*a* of the cartridge 4. The truncated-conical tip 4*a* of the cartridge 4 has a passage opening 4*b* for the first end 19*a* of the paint needle 19. The first end 19*a* of the paint needle 19 and the tip 4*a* of the cartridge 4 are aligned with one another. When the cartridge 4 is installed in the spray gun, the tip 4*a* of the cartridge is located in the outlet area 7 of the spray gun.

In another embodiment not shown, the truncated conical tip 4*a* can also have a cylindrical area in the front end area.

A paint needle spring 303 is provided in the rear end 3*a* of the head for retracting the paint needle 19 or for closing the free end 4*a* of the cartridge 4 through the paint needle 19. This paint needle spring 303 can be arranged in the device 100 for adjusting the material flow. A second part of the paint needle 19 on which the spring acts is connected via a mechanism to the rear end of the paint needle, on which the tappet 27 or the like is arranged. The paint needle 19 is connected via this and possibly an additional mechanism to the trigger bar 22.

With its second end 19*b*, the paint needle 19 penetrates a cap 26 that closes off the end of the cartridge 4 facing away from the outlet area 7. In the present embodiment, the cap 26 is placed as a separate component on the rear end of the tubular area 15 of the cartridge 4, and contacts the tube 15 on the outside with its circumferential rim 26*a*. The cap 26 could also be constructed as a plug or the like that engages with the tube 15, for example. Or simply as a cover that contacts the tube 15. A fixation, whether form fit or force fit, with or without assisting means such as threads, catch tabs, adhesive, welding or the like, is possible.

The paint needle 19 is roughly 50% longer than the tubular material-conducting area 6 of the cartridge 4 and accordingly projects with its free end 19*b* well past the cartridge 4 in the longitudinal direction. The free end 19*b* further has a tappet 27 at its end. A return spring 28 for the paint needle 19 can extend between the cap 26 and the tappet 27. The return spring 28 is supported at a first end on the outer side of the cap 26 and at a second end on the inner side of the tappet 27. In the embodiment according to FIG. 3, the return spring 28 is constructed as a helical spring. It is possible, however, to use a different spring such as a leaf spring, a folded bellows or the like. In order to actuate the paint needle 19, the trigger bar 22 could act on the outer side of the tappet 27, e.g. with a claw, or it could rest against the tappet 27. Other types of action are also possible.

A second paint needle could be coupled to the trigger bar 22 in the rear head area 3*a* of the spray gun and in turn act on or actuate the paint needle 19 in the cartridge 4.

The return spring 28 can be a tension or a compression spring. In a special configuration, the paint needle is opened by the return spring 28 when the trigger bar 22 is pulled, and after release, the trigger bar 22 is pressed by the return spring 28 into the front position and the paint needle 19 closes off the passage opening 4*b*.

In another configuration, the paint needle could be brought into the closed position by a tension spring and pulled back by means of a connection of the trigger bar to the paint needle by pressing on the trigger bar and thereby the passage opening in the tip of the cartridge could be released.

It is also possible to provide the return spring inside the cartridge 4. Such a return spring could be supported at a first end on the inner side of the cap 26 or on a hook or the like provided in the cartridge 4 and be supported at a second end on a hook or the like provided on the paint needle 19.

It goes without saying that functional seals can be provided on or in the cartridge 4, for example on its truncated-conical tip 4*a* and/or the passage opening 4*b* for the paint needle 19. For example, such a seal could be an injection-molded sealing lip, a film seal, a shaped seal, a penetration membrane, a corrugated membrane, a bellows membrane or a ring seal.

The paint needle 19 could also be provided with such or similar functional seals. Or the paint needle 19 itself or the tip 19*a* of the paint needle 19 could consist of a metallic or nonmetallic material with sealing properties or be coated with a corresponding material having sealing properties.

A particularly advantageous embodiment of the return spring or actuating spring 28 is shown in FIGS. 5*a*-5*b*. The spring 28*a* according to the invention is produced integrally with the cap 26 of the cartridge 4. In the present example, the spring consists of two curved, elastic bow spring legs 28*b* and 28*c* having roughly a W shape in a side view. The ends of each "W" are connected to the surface of the cap 26 and the center of the "W" is supported on a stopper 19*c* that is provided on the paint needle 19, specifically in the area of the free end 19*b* thereof that faces the tappet 27. The stopper 19*c* is formed substantially as a truncated-conical projection and faces the center of the "W" with its larger circular surface. One bow spring leg 28*b* runs along the one side of the paint needle 19 and the other bow spring leg 28*c* runs along the other side thereof. The position of the bow spring legs 28*b* and 28*c* in the unassembled state is shown in FIG. 5*a*. The bow spring legs 28*b* and 28*c* then contact the outer surface of the truncated cone 19*c*. In the assembled state, the bow spring legs 28*b* and 28*c* are snapped onto the base area of the truncated cone 19*c*. This retention is achieved in a simple manner when the paint needle 19 is pushed through the passage opening 26*b* in the cap 26. This enables a secure closing of the paint needle 19. It is of course also possible to provide only one such bow spring part 28*b* or 28*c*, or more than two bow spring parts 28*b* and 28*c*. The version shown is optimal, however, because here only a few spring parts (only two) are provided, which run symmetrically alongside the paint needle 19.

The stopper 19*c* could also have a cylindrical or an opposing conical shape, or a different shape such as a disk or ring shape.

For additional safety, the passage opening 26*b* in the closing means of the cartridge 4, constructed here as a cap 26, is equipped with a sealing lip 26*c*. In place of the sealing lip 26*c*, a film seal, a penetration membrane, a corrugated membrane, a bellows membrane, a ring seal or some other seal such as a shaped seal could be provided. This also applies to all other possible embodiments of the closing means.

As FIGS. 5*a* and 5*b* also show, the cap 26 has a plug protrusion 26*d*. In the installed state, the plug protrusion 26*d* rests fittingly on the inside wall of the cylindrical tube 15.

FIG. 5*c* shows a variant in which the multi-leg bow spring shown in FIGS. 5-5*b* is replaced by two single-leg bow springs 28*d*.

In the variant according to FIG. 5*d*, the actuating spring is formed as a helical spring 28*e* that engages with its ends 28*e* 1 and 28*e* 2 in the cap 26 and is braced at its windings 28*e* 3 on the base surface of the truncated cone 19*c*.

In FIG. 5*e*, the actuating or return spring 28*f* for the paint needle 19 is integrally formed on the cap 26. The spring 28*f* in this case is constructed as an angled cantilever spring. The point of action or the stopper of the spring 28*f* on the paint needle 19 in the present embodiment is molded as a circular disk-shaped projection 19*d* onto the paint needle 19. The circular disk 28*f* could also be produced as a separate component, however, and connected to the paint needle 19 by gluing, welding or in some other manner. Other shapes, such as a semicircular disk or a rectangular plate, are also suitable as a stopper. Of course the stopper here could also be formed as in the previously discussed embodiments in a truncated conical shape or have nearly any other geometrical shape. How the paint needle runs 19 through the tubular section 15 of the cartridge 4 and what the inlet area 5 can be like are particularly evident from FIG. 5*e*.

In the embodiment shown here, the paint needle 19 has an incision 304 for mounting or delimiting additional components.

The cartridge 4 is placed manually into a receptacle provided in the front end 3*b* of the spray gun head 3, as will be described in detail later. It is visible from FIG. 6 that the trigger bar 22 of the spray gun acts on the paint needle by means of a first bearing bolt 22*a* in the vicinity of the tappet 27 of the paint needle 19. In the present example according to FIG. 6, the bearing bolt 22*a* is held at both ends by a respective clip 200. The clips 200 have two substantially rectangular plates 201*a* and 201*b* connected to one another via a film hinge 202. The plates 201*a* and 201*b* reach around the trigger bar 22 on its two legs 22*b*. This guarantees the secure positioning of the bearing bolt 22*a* relative to the trigger bar 22. The connection between the bearing bolt 22*a* and the trigger bar 22 is securely guaranteed by their linkage to the clips 200. The connection is particularly secure if the clips and/or the bearing bolt 22*a* are produced from elastic material. Firstly this enables secure retention of the components with respect to one another and secondly it allows soft actuation of the trigger bar 22 with a consistent actuating force.

In another embodiment not shown, the bearing bolt 22*a* could also be integrally produced with clips 200.

The bearing bolt 22*a* preferably has the rectangular cross section shown, but in other embodiments not shown, it can have any desired cross-sections e.g. oval or round and/or can have pockets, claws, hooks. etc. for driving a paint needle, e.g. the tappet 27 of the paint needle 19. Other, alternative forms of action and engagement are also possible.

Other alternative types of mounting of the bearing bolt on the trigger bar such as notches, bores, slotted holes etc. are possible.

The second ordinary bearing pin 22*d* for the trigger bar 22 is also visible from FIG. 6.

The trigger bar 22 and thus ultimately the paint needle 19 can be actuated manually in the usual manner by pressing and releasing. It is also possible to additionally actuate the trigger bar 22 and or the paint needle 19 pneumatically, hydraulically, by magnetic fields, electrically or by a combination thereof.

An optional additional type of actuation can also be linear, rotational, by displacement of two or more surfaces (rotary valve, e.g. ball valve), rotary plus linear (e.g. a threaded drive analogous to a water tap).

The above-described arrangement of cartridge 4 and optionally a paint needle 19 along with air distributor 18 is held by means of a collar ring 10, into which the air distributor 18 and the cartridge 4 are inserted in the present embodiment. The collar ring 10 preferably consists of plastic and has a roughly semicircular protrusion 11 on its side facing the air distributor 18. The protrusion 11 is dimensionally matched to the circumferential dimension of the tubular inlet area 5 of the cartridge 4. In the assembled state, the protrusion 11 is fitted to and supported on the tube 5. The protrusion 11 preferably has resiliently elastic properties. It can be produced integrally with the collar ring 10, but need not be. It can be clamped, clipped or glued onto the collar ring 10 or mounted in some other manner thereon.

Offset by roughly 180° from the protrusion 11, a substantially cuboid mounting block 29 is located on the collar ring 10. In the assembled state, i.e. when the cartridge 4 is inserted into the front end 3*b* of the spray gun head 3, the mounting block 29 engages with a correspondingly shaped receptacle 30 provided in the spray gun. In the present embodiment, the receptacle 30 is an elongated hole (or pocket) that is arranged in the rear end 3*a* of the spray gun.

The mounting block 29 is penetrated at its free end by a bearing axle 29*a*, which projects laterally out of the mounting block 29 at each end. The mounting block 29 can be displaced with its bearing axle 29*a* along the receptacle 30 in the spray gun. Stops 30*a* and 30*b* limit the possible travel of the bearing axis 29*a* in the receptacle 30.

In the present embodiment, the mounting block 29 has resiliently elastic properties. It can be produced integrally with the collar ring 10, but need not be. The mounting block can be constructed in one or more parts and can, for example, also be clamped, clipped or glued onto the collar ring 10 or mounted thereon in some other manner.

The mounting block 29 can also be produced from a rigid material, however.

It goes without saying that it is particularly advantageous for reasons of production if the entire collar ring 10, i.e. the circular ring with the protrusion 11 and block 29, is integrally produced.

The mounting block 29 can of course also be produced differently, for example as a mounting ball, hinge, e.g. a thin-film hinge, etc. It is only essential that a secure mounting of the collar ring 10 on the spray gun be guaranteed. Both detachable and non-detachable connections are possible, depending on whether the collar ring 10 is intended to remain on the spray gun permanently or not.

Hook, bayonet or catch tab connections, which are arranged radially or axially, can be arranged for detachable connection of the two parts 3*a* and 3*b* of the head 3 or the collar ring 10 to the other components.

Depending on the individual requirement, stops for limiting motion can also be provided here.

The locking and unlocking can be done manually, pneumatically, magnetically, electrically, via friction forces and via acceleration, automatically or manually.

It is also possible for the collar ring 10 to be integrally produced with the air distributor 18 and/or the cartridge 4.

The collar ring 10 is equipped with a thread 32 its outer surface 31. The thread 32 is constructed as a full thread in the present embodiment. An air nozzle can be mounted on the thread 32 directly or indirectly by means of a threaded ring. The air nozzle can consist of steel, other metals or of plastic.

Such an air nozzle can be produced as a round jet nozzle or with at least one horn for forming a broad jet. Bores or air outlet openings for jet formation are inserted into the horn. The bores or openings in the horn and or the round jet bore(s) can also be non-cylindrical or have any desired cross sections.

In a further configuration, it is possible that the air distributor is or can be connected directly or indirectly to at least one additional air distribution means.

For example, a horn can be attached with a force or form fit, glued or welded onto the air distributor.

The horn or some other air distribution means can also be integrally produced with the air distributor.

As already mentioned, the shape of the cartridge receptacle in the spray gun must of course be matched to the shape of the cartridge, optionally together with the previously described additional parts of a collar ring 10, air distributor 18, etc., or the cartridge shape, optionally in addition to additional parts (e.g. air distributor), must be matched to the shape of the cartridge receptacle.

Individual or all components can be connected to one another by means of friction, spring force or in some other manner, with a force or form fit. If necessary, the components can be supported on one another via abutments and/or additional mounting means.

In the operation of the spray gun according to the invention, the handle area 2 and the head area 3*b* of the spray gun are in the "locked" state by means of the joint 23 (see FIGS. 1 and 4). Locking is accomplished by means of the previously described control button 24. In the spraying position of the gun, paint can flow from the supply container, not shown, through the angled tubular inlet area 5 into the channel 6 of the cartridge 4, which guides the paint needle 19, and through this cartridge 4 up to its free end 4*a*, i.e. to the outlet area 7 arranged at the front end 8 of the spray gun head 3. The paint needle 19 can be actuated by means of the trigger bar 22. Depending on the trigger position, the paint needle 19 will be either retracted, the outlet 7 area then being free, and the spray process can then take place, or the paint needle 19 is pushed forward, the outlet area 7 then being closed, and spraying cannot take place. As already mentioned, the material quantity can be regulated via a device, of which only the regulation screw 100 is shown here, arranged in the spray gun.

Perfect guidance of the paint needle 19 is guaranteed in particular by the previously described return spring 28, which is supported at one end on the tappet 27 of the paint needle 19 and at the other on the cap 26 of the cartridge 4. The desired spray pattern can be achieved by means of the special guidance through the passage openings 18*e* in the air distributor 18 and the air cap with horns optionally attached to the spray gun and mounted on the outside thread 32 of the collar ring 10. The quantity and pressure of the air can be regulated by means of the previously described air micrometer 21.

After completion of the spraying process, the control button 24 is turned into the "locked" position (see FIG. 4*a*), whereby the areas 3*a* and 3*b* of the head 3 are pushed apart in the direction of the axis of paint needle 19 and can then be folded apart from one another by approximately 90°, so that the area 3*b* that guides the cartridge 4 runs approximately parallel to the handle 2 of the spray gun (see FIG. 2). In this case, the supply container for the paint or other material to be sprayed can still be connected to the cartridge 4 or can already have been separated therefrom.

During the pushing apart, the bearing axle 29*a* of the mounting block 29 for the collar ring 10 moves from the rear stop 30*a* of the receptacle 30 along the recess 30 up to the front stop 30*b* of the receptacle 30. After the head area 3*b* has been rotated about the bearing axle 29*a* by approximately 90°, the arrangement consisting of the collar ring 10 and the cartridge 4 together with the air distributor 18 and the like is sufficiently far away from the spray gun that the cartridge 4 is freely accessible. The used cartridge 4, possibly containing paint residues, together with the air distributor 18 and the return spring 28 or 28*a* can now be pulled off without problems from the collar ring 10 in the front end 3*b* of the head 3, discarded and replaced by a different, new and clean cartridge before a new spraying process. Cleaning the spray gun itself is at most necessary in the area of the air nozzle, if present.

By virtue of the fact that the cartridge 4 is sealed off at both ends by the paint needle 19, material to be sprayed can be stored in the combination of the cartridge 4 and the supply container without drying out. The cartridge 4 can therefore also be reused without contaminating the spray gun.

If desired, the air distributor 18 can still be used one or more times, because it is not contaminated at all.

Plastics that can be considered for the cartridges for all of the above-described components include, for example, PE, PA, POM, PEEK, which may be reinforced with glass fibers.

The spray gun can be produced from a metal such as steel, brass, aluminum, sinter metals, titanium or alloys thereof. Production from ceramic and other hard materials is also possible.

The cartridge can also be made from the same materials as the spray gun. Because the cartridge is then relatively valuable, it can possibly be reused several times. The cleaning effort for the spray gun is slight even in this case, because only the cartridge has to be cleaned if it is to be reused with a change of spraying material.

In the embodiment shown in FIG. 7, the air distributor 18 is integrally produced with the collar ring 10. The air distributor 18 here, similarly to the air distributor 18 that can be seen especially well in FIG. 3*a*, has several areas 18*a*-18*d* (identical items are furnished with identical reference numbers). The area 18*a* is molded onto the outer surface 31 of the collar ring 10. In this air distributor 18, the areas 18*b* and 18*c* have a few circular air holes 18*e*, but they can also have the number of air holes 18*e* shown in FIG. 3*a* or other numbers of air holes and air hole designs.

The one-piece design is particularly advantageous because absolutely no positioning of the air distributor 18 relative to the collar ring 10 is necessary.

This air distributor 18 likewise has a slotted guide 17*e*, which is provided on a mounting disk 17. The cartridge 4, which is constructed here like the cartridge 4 shown in FIG. 3*a*, can be inserted into the collar ring 10. In FIG. 4 as well, the same elements and items as those in the cartridge 4 according to FIG. 3*a* are present in the cartridge 4. Identical elements and items are furnished with identical reference numbers.

A second spray gun according to the invention is shown in FIGS. 8-10. As usual, the spray gun has a gun body 1 with a handle 2 and a head 3. These two subsections 2 and 3 run at an angle of approximately 100° relative to one another, as is usual. The handle area 2 has a compressed air connection 20 at its lower end. A number of air channels (to be discussed later), which end at the front end 8 of the spray gun head 3, extend from the compressed air connection 20 through the handle area 2 and through the head 3. The amount and pressure of air flowing through these air channels can be regulated in the usual manner by means of an air micrometer 21. The material stream can be regulated by means of a device, of which only a regulation screw 100 and an adjustment button 101 are shown here.

The head 3 here does not have any parts that can be folded apart from one another. In another embodiment, the head could also have parts that can be folded apart from one another, however.

The front end 8 of the head 3 is equipped with a known conventionally designed air nozzle 33 having two horns 33*a*, 33*b* projecting in the direction of the spray jet with openings 33*c* in the mutually facing surfaces. The air nozzle 33 is mounted on the spray gun, more particularly on the cartridge 4 thereof, by means of a likewise conventionally known air nozzle ring 13. For this purpose, the cartridge 4 (like the cartridges from the previously described figures) has a collar ring 10, which is injection-molded onto the free end 4*a* of the cartridge 4 in the present embodiment. On its outer surface 31, the collar ring 10 has a thread 32 onto which the air nozzle ring 13 can be screwed with its inside thread according to the invention. The air nozzle ring 13 extends almost up to the inlet area 5 of the cartridge 4.

The cartridge 4 according to FIGS. 8-10 also has a tubular inlet area 5 with a bracket 16. The bracket 16 extends here as well somewhat beyond half the circumference of the tube 5 and is half as high as the tube, but does not have a connecting rail like the mounting bracket according to FIG. 3*a*. That is also not necessary, because the bracket 16 in the embodiment according to FIGS. 8-10 is not used as a mounting bracket for the material supply container or the like. Such a component can be connected by engagement in the tubular inlet area 5 with the cartridge 4, a projection 16*c* for engagement with a mating projection or the like being provided in the interior of the bracket.

The cartridge 4 is supported in part by the bracket 16 on the head 3 of the spray gun. In the special case shown here, the bracket 16 rests with its outer surface on the correspondingly shaped outer surface of the suspension hook 36 for the spray gun.

According to FIGS. 9 and 10, on the other hand, a catch hook 37 that is integrally molded onto the tubular area 15 of the cartridge 4 via a film hinge 37*a* is provided on either side of the cartridge 4. Each catch hook 37 can be deflected sideways via its film hinge 37*a*. The catch hooks 37 are used for detachably mounting the cartridge 4 on the spray gun head 3, which has slots 38 corresponding to the shape of the catch hooks 37 in its two side walls. In the embodiment according to FIGS. 8-10, the catch hooks 37 are substantially triangular in a plan view and each have a barb 37*b* at a tip facing away from the film hinge 37*a*. The catch hooks 37 are roughly as long as the collar ring 10 is high. Such relatively long catch hooks 37 can be easily operated manually.

The slots 38 in the spray gun can also be configured as bores or simple recesses or the like.

During operation of the spray gun, a subsection of the catch hooks 37 extends into the lateral slots 38 of the spray gun and another subsection of the catch hooks 37 is outside (cf. FIG. 8). After usage of the spray gun, when the air nozzle ring 13 has been unscrewed, pressure in the direction of the arrow 301 according to FIG. 10 can be exerted onto the catch hooks 37 via the part of the catch hooks 37 on the outside, so that the catch hooks swing outward in the direction of the arrow 302 according to FIG. 9. The cartridge 4 can be grasped at the collar ring 10, pulled off the head 3 of the spray gun in the spray jet direction 300 and discarded.

Thus the cartridge 4 is very securely mounted on the spray gun by means of the collar ring 10 and the catch hooks 37 on the one hand and by means of the air nozzle ring 13 on the other, but is also mounted so as to be easily detachable.

In the state where it is completely screwed on, the air nozzle ring 13 presses against the surface 37*c* of the previously described catch hooks 37. The barbs 37*b* of the catch hooks 37 are pressed thereby against the gun head 3, whereby a secure retention of the collar ring 10 on the spray gun results. The cartridge 4 can therefore neither move in the spray jet direction 300 nor laterally back and forth in the spray gun. This guarantees a mounting of the cartridge 4 on the spray gun that is always secure but easily detachable after use.

A similar secure retention can also be achieved with an air nozzle ring, however, which does not extend nearly up to the inlet area 5 of the cartridge 4 as in the present embodiment.

In another embodiment not shown, the catch hooks 37 or the film hinge 37*a* can be constructed sufficiently stiffly or designed in such a manner that the additional securing of the catch hooks 37 by the air nozzle ring 13 is not necessary and the catch hooks 37 nevertheless engage securely in the gun head 3, without impairing the detachability thereof.

In another possible embodiment, the air nozzle, with or without an integrated air distributor, is mounted directly on the spray gun or is fixed directly to the cartridge without a collar ring.

The cartridge 4 in FIGS. 11 and 12 is equipped with the helical spring 28*e* according to FIG. 5*d*. (Identical items are furnished with identical reference numbers). The tubular area 15 of the cartridge 4 is also equipped with a mounting disk 17 already described in detail with reference to FIG. 3*a*. It is recognizable in FIG. 12 that the cartridge 4 is furnished on its tubular area 15 with a circumferential catch ring 15*a* or the like for the mounting disk 17. The mounting disk 17 in this case has a bushing 17*d* through which the cartridge 4 extends. A special air distributor 18 is pushed onto the bushing 17*d*. The air distributor 18 is closed off at its front end with a wall 18*a* having a central passage opening 18*f* for the cartridge 4. In addition, the wall 18*a* is provided with some air holes 18*e*. This is very advantageous for achieving a good uniform spray pattern with the desired atomization.

FIG. 11 in particular shows that the mounting disk 17 or the air distributor 18 can have a (further) positioning aid 12 on its rear side.

In the embodiment according to FIGS. 13 and 14, the air distributor 18 is formed and mounted on the cartridge 4 exactly like that from FIGS. 11 and 12, namely by means of a very specifically designed collar ring 10. The collar ring 10 here is cylindrically formed and equipped in the center with an insert 10*a*, which is integrally produced with the collar ring 10, but can also be mounted in a different manner therein, by gluing, for example. The insert 10*a* is furnished with a passage opening 10*b* for the tubular area 15 of the cartridge 4. An air distributor 18, which is formed identically to the air distributor according to FIGS. 11 and 12, but can also be constructed differently, is inserted in the front area of the collar ring 10. In the present embodiment it is not the cartridge 4 that has the catch hooks 37 on each side (as in the embodiment according to FIGS. 9 and 10), but rather the collar ring 10. Each catch hook 37 is integrally formed on the inside of the collar ring 10 by means of a film hinge 37*a*. The catch hooks 37 can be deflected laterally via the film hinges 37*a*. The catch hooks 37 are used for detachable mounting of the collar ring 10 together with the cartridge 4 and the air distributor 18 on the head 3 of the spray gun, which has slots 38, bores, other recesses etc. corresponding to the shape of the catch hooks 37 in its two side walls (cf. FIG. 9).

In the fully screwed-on state, the air nozzle ring, not shown here, presses against the surface 37*c* of the previously described catch hooks 37, arranged here on the collar ring 10. The barbs 37*b* of the catch hooks 37 are pressed thereby against the gun head 3, whereby a secure retention of the collar ring 10 on the spray gun results. The cartridge 4 can therefore neither move in the spray jet direction 300 nor laterally back and forth in the spray gun. This guarantees a mounting of the cartridge 4 on the spray gun that is always secure but easily detachable after use.

In another embodiment, not shown, the catch hooks 37 or the film hinge 37*a* also can be constructed sufficiently rigidly or designed such that it is not necessary to additionally secure the catch hooks 37 with the air nozzle ring, and the catch hooks 37 nevertheless securely engage with the gun head, without impairing the detachability therefrom.

The third spray gun according to the invention as shown in FIGS. 15 and 16 corresponds in many parts to the spray gun shown in FIG. 8. Thus it has a gun body 1 with a handle area 2 and a head 3. These subsections 2 and 3 run at an angle of roughly 100° relative to one another. The handle area 2 has a compressed air connection 20 at its lower end. Several air channels, which end at the front end 8 of the spray gun head 3, extend from the compressed air connection 20 through the handle area 2 and the head 3. The amount and pressure of air flowing through these air channels can be regulated in the usual manner by means of an air micrometer 21. The material stream can be regulated by means of a device, not shown in detail, of which a regulation screw 100 and an adjustment button 101 are shown here.

The head 3 of the spray gun according to FIGS. 15 and 16 does not have parts that can be folded apart from one another, but could have foldable parts.

The front end 8 of the head 3 is equipped here as well with a known conventionally designed air nozzle 33, which here has horns 33*a*, 33*b* extending in the spray jet direction with openings 33*c* in their facing surfaces. The air nozzle 33 is fastened by means of a likewise known air nozzle ring 13 to the spray gun, similarly to the embodiment according to FIG. 8.

The cartridge 4 according to FIGS. 15 and 16 substantially corresponds to the cartridge 4 shown in FIGS. 11 and 12. The cartridge 4 has an angled-off tubular inlet area 5 for a material-conducting channel 6 that terminates in an outlet area 7 that is arranged at the front end 8 of the spray gun head 3. Here too, a paint needle 19 is provided as a material-conducting component 9. The tubular inlet area 5 is provided with a bracket 16. The bracket 16 extends over roughly half the circumference of the tube 5 and is roughly half as high as the latter. The cartridge 4 can be supported via the bracket 16 on the spray gun head 3; the bracket 16 rests at its outer surface on the correspondingly shaped outer surface of the suspension hook 36 for the spray gun.

The bracket 16 is used in the present embodiment for mounting the supply container for the material to be sprayed.

The cartridge 4 is equipped with an air distributor 18, which is closed off at its front end by a wall 18*a* that is provided with some air holes 18*e*. The air distributor 18 here is produced integrally with the cartridge 4; the mounting disk 17 or the like as described with reference to FIG. 12 can therefore be eliminated in this case. In addition, the connectors 17*a* and 17*b* described with reference to FIGS. 3*a* and 3*b* are provided on the air distributor 18 (only one connector 17*a* is visible in FIG. 16). However, only one connector, several connectors, different connectors or the like as well as connectors in a different arrangement can also be provided for air guidance on the air distributor 18 according to FIG. 16.

As FIG. 16 further shows, the cartridge 4 can be inserted into air channels of the spray gun with the connectors 17. Sealing rings or the like can of course also be provided here. The structure is retained on the head 3 of the spray gun by means of the air nozzle ring 13. For this purpose, the head 3 has a conventionally known outside thread 3*c* at its end 3*b* for detachable connection of the conventionally known air nozzle ring 13 that is screwed for this purpose onto the air gun via its inside thread 13*a*. The air nozzle ring 13 extends almost up to the inlet area 5 of the cartridge 4. Thereby it is assured that the cartridge 4 cannot move back and forth in an undesired manner in the spray gun.

The cartridge 4 is thus very securely mounted on the spray gun, mainly by means of the air nozzle ring 13, but can easily be detachably mounted if necessary.

In another embodiment, the air nozzle interior is supported on the front side of the cartridge or parts thereof (e.g. on the air distributor) and is fixed in the gun just like the cartridge by the air nozzle ring after it has been screwed on.

In other embodiments, the cartridge can also be supported opposite the spraying direction against the gun head 3 by means of the mounting disk 17, the cap 26, the tubular inlet 5, a stop on the first cartridge area 15 or a combination thereof.

In all embodiments, detachable connections between a collar ring 10 and the spray gun are described. However, embodiments in which a collar ring is non-detachably connected to the spray gun are also possible. This would be advantageous for the spray gun operation, particularly for a multifunction collar ring that is constructed identically or similarly to the collar ring 10 already shown in FIG. 3*a* or 14. The cartridge 4 or another insert, which could be advantageously constructed as a film, bag or the like, can also be securely but detachably connected to the spray gun by means of such a collar ring non-detachably connected to the spray gun.

In all embodiments, the air nozzle 33 could also be integrally constructed with the air nozzle ring 13.

Instead of being screwed onto a fastening element, the air nozzle ring 13, with or without an air nozzle 33, could instead be snapped on or connected by a quick connector, a bayonet mount or another mounting means to the spray gun.

Finally it may pointed out that material-conducting components 9 other than the paint needles 19, and/or cartridges 4 without material-conducting components 9 also fall under the invention. Elements of the invention can likewise be applied to types of spray guns different from those shown and described, with or without a head that can be folded down.

It also goes without saying that the shown and described items can be combined in whole or in part in arbitrary meaningful manners or be omitted in whole or in part.

The invention claimed is:

1. A spray gun system for delivery of a flowable material under pressure, the system comprising a spray gun and a cartridge removably attached to the spray gun so that a gas supplied to the spray gun provides gas pressure to a flowable material supplied to the cartridge resulting in delivery of the flowable material under pressure, wherein the spray gun comprises a gun body having a handle portion, a head for receiving the cartridge, and a slot for receiving the cartridge to removably attach the cartridge to the spray gun, wherein the cartridge comprises: a body with a material-conducting conduit running therethrough with an angled-off tubular inlet area as an inlet connectable to a container storing the flowable material, the material-conducting conduit terminating in an outlet; a collar ring fixed to the body having an outer thread for threadably receiving an air nozzle ring for securing an air nozzle to the cartridge; a bracket arranged on the tubular inlet area for supporting the cartridge when the cartridge is attached to the spray gun; and a catch hook mounted on the body of the cartridge by a film hinge, the film hinge allowing deflection of the catch hook to selectively engage and disengage with the slot on the spray gun body to removably attach the cartridge to the spray gun an air nozzle and an air nozzle ring for securing the air nozzle to the cartridge, wherein the air nozzle ring has a threaded inner surface for threadably engaging the collar ring and wherein air nozzle ring deflects the catch hook toward the slot when the air nozzle ring is screwed on the collar ring.

2. The spray gun system according to claim 1, wherein the catch hook has a barb engaging the slot.

3. The spray gun system according to claim 1, further comprising an air nozzle and an air nozzle ring for securing the air nozzle to the cartridge, wherein the air nozzle ring has a threaded inner surface for threadably engaging the collar ring.

4. The spray gun system according to claim 3, wherein the air nozzle ring reaches at least approximately up to the tubular inlet area of the cartridge when the air nozzle ring is completely screwed on the collar ring.

5. The Spray gun system according to claim 3, wherein screwing the air nozzle ring on the collar ring creates an additional attachment of the cartridge to the spray gun.

6. The spray gun system according to claim 1, wherein the head has two areas connected in an articulated manner to one another that can be folded apart from one another.

7. The spray gun system according to claim 1, wherein the collar ring can be detachably connected to the spray gun via a slip-on process.

8. The spray gun system according to claim 1, wherein the collar ring is non-detachably connected to the spray gun.

9. The spray gun system according to claim 1, wherein the collar ring is non-detachably connected to at least one air-conducting or material-conducting part of the spray gun.

10. The spray gun system according to claim 9, wherein the collar ring is integrally produced to the at least one air-conducting or material-conducting part of the spray gun.

11. The spray gun system according to claim 1, further comprising an air distributor.

12. The spray gun system according to claim 1, wherein the air distributor has several areas arranged one alongside another or one atop another, wherein at least one of the areas has at least one air hole.

13. The spray gun system according to claim 11, further comprising an air nozzle, wherein the air distributor and the air nozzle are a one piece assembly.

14. The spray gun system of claim 1, wherein the gun body of the spray gun includes a suspension hook and wherein an outer surface of the bracket of the body of the cartridge rests against the suspension hook when the cartridge is attached to the spray gun.

15. The spray gun system of claim 14, wherein the tubular inlet area has a projection for engaging the container storing the flowable material.

16. The spray gun system of claim 15, wherein the bracket has a height and the tubular inlet area has a length and wherein the height of the bracket is about half the length of the tubular inlet area.

* * * * *